US005610475A

United States Patent [19]

Chen

[11] Patent Number: 5,610,475

[45] Date of Patent: *Mar. 11, 1997

[54] DYNAMIC OFF-AXIS DEFOCUSING CORRECTION FOR DEFLECTION LENS CRT

[75] Inventor: Hsing-Yao Chen, Barrington, Ill.

[73] Assignee: Chunghwa Picture Tubes, Ltd., Taoyuan, Taiwan

[ * ] Notice: The term of this patent shall not extend beyond the expiration date of Pat. No. 5,412,277.

[21] Appl. No.: 412,268

[22] Filed: Mar. 28, 1995

Related U.S. Application Data

[63] Continuation-in-part of Ser. No. 111,566, Aug. 25, 1993, Pat. No. 5,412,277.

[51] Int. Cl.[6] ..... H01J 29/70

[52] U.S. Cl. ..... 313/414; 313/412

[58] Field of Search ..... 313/409, 412, 313/413, 414; 315/15, 382

[56] References Cited

U.S. PATENT DOCUMENTS

| | | | |
|---|---|---|---|
| 4,620,133 | 10/1986 | Morrell et al. | 315/15 |
| 5,055,749 | 10/1991 | Chen et al. | 315/382 |
| 5,061,881 | 10/1991 | Suzuki et al. | 315/382 |
| 5,066,887 | 11/1991 | New | 313/414 |
| 5,091,673 | 2/1992 | Shimona et al. | 313/412 |
| 5,162,695 | 11/1992 | Shimona et al. | 313/412 |
| 5,196,762 | 3/1993 | Go | 313/414 |
| 5,212,423 | 5/1993 | Noguchi et al. | 313/414 |
| 5,281,892 | 1/1994 | Kweon et al. | 313/414 |
| 5,291,093 | 3/1994 | Lee | 313/414 |
| 5,399,932 | 3/1995 | Anzai et al. | 313/414 |
| 5,412,277 | 5/1995 | Chen | 313/414 |

*Primary Examiner*—Michael Horabik
*Assistant Examiner*—Michael Day
*Attorney, Agent, or Firm*—Emrich & Dithmar

[57] ABSTRACT

An electron gun for use in a cathode ray tube (CRT) includes a cathode, a low voltage beam forming region (BFR), and a high voltage deflection focus lens disposed in the beam deflection region of the CRT's magnetic deflection yoke for simultaneous and coincident focusing and deflection of the electron beam on the CRT's display screen. The deflection lens includes a plurality of first focus grids disposed in the CRT's neck portion including a spaced first pair of grids (G42, G44) having respective beam passing apertures disposed horizontally off-center in opposed directions relative to the electron beam axis, and a second pair of grids (G46, G48) having respective beam passing apertures disposed vertically off-center in opposed directions relative to the axis. Other grids disposed on opposed sides of each of the first and second pair of grids have respective beam passing apertures centered with respect to the electron beam axis and are maintained at a fixed focus voltage. A first dynamic focus correction voltage source (275) and a second dynamic focus correction voltage source (277) which vary with the electron beam deflection are respectively applied to each of the first and second pair of grids for compensating for asymmetric off-axis electron beam defocusing at all points on the CRT's faceplate. This dynamic off-axis defocusing correction is equally applicable in a single beam, monochromatic deflection lens CRT, as well as in a multi-beam, color deflection lens CRT.

26 Claims, 20 Drawing Sheets

EQUAL OFFSET (ALL 3 GUN)

OFFSET UP PLATE (FOR DEF. DOWN)

G 48

EQUAL OFFSET (ALL 3 GUN)

OFFSET DOWN PLATE (FOR DEF. UP)

G46

CONCENTRIC PLATE (FOR CONTROL)

G41, G43, G45, G47, G49 least offset medium offset largest offset

OFFSET RIGHT PLATE (FOR DEF. LEFT)

G44 largest offset medium offset least offset

OFFSET LEFT PLATE (FOR DEF. RIGHT)

G42

DYNAMIC OFF-AXIS DEFOCUSING CORRECTION FOR DEFLECTION LENS CRT

CROSS-REFERENCE TO RELATED APPLICATION

This is a continuation-in-part application under 37 CFR §1.60 of pending prior application, Ser. No. 08/111,566 filed Aug. 25, 1993, now U.S. Pat. No. 5,412,277, for DYNAMIC OFF-AXIS DEFOCUSING CORRECTION FOR DEFLECTION LENS CRT.

FIELD OF THE INVENTION

This invention relates generally to cathode ray tubes (CRTs) incorporating an electron beam deflection lens in the CRT's magnetic deflection region and is particularly directed to a dynamic lens in an electron gun for compensating for off-axis electron beam defocusing in a deflection lens CRT.

BACKGROUND OF THE INVENTION

Referring to FIG. 1, there is shown a longitudinal sectional view of a prior art color deflection lens (DFL) CRT 50. A single beam, monochrome DFL CRT is described and claimed in co-pending application, Ser. No. 07/874,043, filed Apr. 27, 1992, now U.S. Pat. No. 5,327,044, and entitled "Electron Beam Deflection Lens for CRT," while a multi-beam, color DFL CRT is described and claimed in U.S. Pat. No. 5,204,585, issued Apr. 20, 1993, and entitled "Electron Beam Deflection Lens for Color CRT." The present invention is applicable to the inventions described and claimed in the aforementioned patent application and issued patent, the disclosures of which are hereby incorporated by reference in the present application.

CRT 50 is of the multi-beam, or color, type and includes a sealed glass envelope 68 having a generally cylindrical neck portion 68*a*, a frusto-conical funnel portion 68*b*, and a display screen 54. Disposed in a sealed manner on an aft portion of the glass envelope's neck portion 68*a* is a plug-like connector 58 comprised of a plastic housing 64 and a plurality of conductive pins 72 extending in a sealed manner through a distal end of the glass envelope's neck portion. Disposed on an inner surface of display screen 54 is a phosphor layer 56 responsive to an electron beam incident thereon for providing a video image. The phosphor layer 56 is in the form of a large number of discrete phosphor elements arranged in groups of three for each of the primary colors, i.e., red, green and blue. A charged metal shadow mask 82 having a large number of apertures therein is disposed immediately adjacent to the phosphor layer 56. Each of the apertures in shadow mask 82 is aligned with a respective one of the aforementioned phosphor elements in phosphor layer 56 for allowing an electron beam to be incident upon the phosphor element as the electron beams are swept across the inner surface of display screen 54 in a raster-like manner. The charged shadow mask 82 serves as a color selection grid, ensuring that each of the three electron beams 52*a*, 52*b* and 52*c* (shown in dotted-line form) lands only on its assigned phosphor elements, or deposits.

Disposed within DFL CRT 50 is a multi-grid electron gun 51 including, in proceeding toward display screen 54, a low voltage beam forming region (BFR) 74, a prefocus lens 76 and a high voltage deflection focus lens 78. FIG. 2 is a longitudinal sectional view of the various charged grids of electron gun 51. Energetic electrons are emitted by three heated cathodes $K_R$, $K_G$ and $K_B$ for each of the primary colors of red, green and blue. BFR 74 is aligned with the three cathodes to receive the energetic electrons and form these electrons into the aforementioned three electron beams 52*a*, 52*b* and 52*c*. BFR 74 includes a $G_1$ control grid, a $G_2$ screen grid and a facing portion of a $G_3$ grid. The three electron beams 52*a*, 52*b* and 52*c* are then directed to the prefocus lens 76 which includes a $G_5$ grid, a $G_4$ grid and a facing portion of the $G_3$ grid. The electron beams then are directed through the deflection focus lens 78 which includes a $G_6$ grid and a facing portion of the $G_5$ grid. Disposed about and engaging the $G_5$ grid is a support, or convergence, cup 60. Attached to support cup 60 about its periphery are a plurality of contact clips, or bulb spacers, where two such contact clips are shown as elements 62*a* and 62*b* in FIG. 1. Contact clips 62*a* and 62*b* engage an adjacent inner surface of the neck portion 68*a* of the CRT's glass envelope 68 upon which is disposed a resistive coating 84. The combination of support cup 60 and contact clips 62*a* and 62*b* as well as a plurality of glass beads attached to each of the grids (which are not shown in the figure) provide secure support for electron gun 51 in CRT 50.

Within the deflection focus lens 78, the $G_6$ grid may be in the form of either a conductive layer disposed on the inner surface of the glass envelope's frusto-conical funnel portion 68*b*, or may be in the form of a frusto-conical metallic element disposed immediately adjacent to the inner surface of the frusto-conical funnel portion 68*b* of the CRT's glass envelope 68. The $G_6$ grid is maintained at a high anode, or accelerating, voltage, while the remaining grids in electron gun 51 are maintained at various lesser voltages for focusing the three electron beams 52*a*, 52*b* and 52*c* on the CRT's faceplate 54. The three electron beams 52*a*, 52*b* and 52*c* also pass through a beam deflection region 80 defined by a magnetic deflection yoke 66 disposed about the CRT's glass envelope 68 generally where its neck portion 68*a* meets its frusto-conical funnel portion 68*b*. Deflection yoke 66 displaces the three electron beams 52*a*, 52*b* and 52*c* across display screen 54 in a raster-like manner, executing a beam retrace following a complete scan of the display screen. By positioning one or more grids of the CRT's main focus lens on, or in closely spaced relation to, an inner surface of the CRT's glass envelope 68, the main focus lens may be positioned within the deflection yoke's magnetic field so as to locate the deflection center of the beams within the focal point of the main focus lens in forming a beam deflection lens. The deflection lens not only focuses the beams on the CRT's display screen 54, but also increases beam deflection sensitivity as the beam is deflected by the magnetic deflection yoke 66. Co-locating the CRT's main focus lens and beam deflection region 80 also reduces lens spherical aberration of the beams and allows for shorter CRT length as described in the aforementioned co-pending application and issued patent.

As the electron beams are deflected across the CRT's display screen 54, they are displaced from the CRT's longitudinal axis A–A'. Deflection of the electron beams from the CRT's axis gives rise to an imbalance in the symmetrical electrostatic forces applied to the beams by the various charged grids of the CRT's electron gun 51. This effect is shown in the simplified schematic diagram of FIG. 3 of a CRT 90 having a glass envelope 92 with a neck portion 92*a*, a funnel portion 92*b* and a display screen 92*c*. Electron beam 96 is generated and directed onto display screen 92*c* by an electron gun as described above which is not shown in the figure for simplicity. Electron beam 96 is disposed along the CRT's longitudinal axis B–B' in the neck portion 92*a* of the CRT's glass envelope 92. The deflection focus lens in CRT 90 is shown in the figure in dotted-line form as element 91 and is located in the CRT where the electron beam 96 is magnetically deflected. As electron beam 96 is deflected across faceplate 92*c* by a magnetic deflection yoke 94, an unsymmetrical force is applied to the electron beam in the direction of, or toward, the CRT's longitudinal axis B–B'. For example, where the electron beam is deflected upward above axis B–B' as shown for the case of electron beam 90*a*, a downward force F is exerted on the electron beam as shown in the figure. Similarly, where the electron beam is deflected downward below axis B–B' as shown for the case of electron beam 96*b* in dotted-line form, an upwardly directed force F' is exerted on the electron beam urging it toward the CRT's axis B–B'. The force exerted on the electron beam is unsymmetrical and increases with the deflection of the beam from axis B–B'. Thus, when the beam is fully deflected adjacent to an edge of display screen 92*c*, the axis-directed force exerted on the beam is maximum. This unsymmetrical, off-axis force gives rise to defocusing of the electron beam and an unsymmetrical electron beam spot on the CRT's display screen 92*c*. For example, in the case of the upwardly deflected electron beam 96*a*, downwardly directed force F gives rise to a teardrop-shaped electron beam spot 98*a* having a tail directed toward axis B–B'. Similarly, for the downwardly directed electron beam 96*b*, upwardly directed force F' gives rise to a teardrop-shaped electron beam spot 98*b* on the CRT's faceplate 92*c* with a tail directed toward axis B–B'. Although this discussion of beam defocusing and beam spot distortion is in terms of beam vertical deflection, a similar defocusing effect occurs when the electron beam 96*b* is horizontally deflected to the right and left of the CRT's axis B–B'.

FIG. 4 is a simplified plan view of the CRT's display screen 92*c* illustrating the manner in which defocusing of the electron beam causes electron beam spot distortion with off-axis deflection of the electron beam. For example, electron beam spots 102 and 104 which lie on the horizontal centerline of display screen 92*c* are teardrop-shaped with a tail directed inwardly toward the center of the display screen. Similarly, electron beam spot 100 which lies on the vertical centerline of the CRT's faceplate 92*c* is teardrop-shaped with a tail directed downward toward the center of the display screen. Electron beam spots 106 and 108, which are off-axis, similarly are teardrop-shaped having tails directed toward the display screen's center. Only electron beam spot 110 has the desired circular shape because it is located at the center of the CRT's display screen 92*c* and is undeflected from the CRT's axis.

The present invention addresses the aforementioned limitations of the prior art by providing dynamic off-axis defocusing correction for a deflection lens CRT. The present invention incorporates an unsymmetrical correction focus lens in the CRT's electron gun to correct for off-axis defocusing and provide a well defined, circular electron beam spot over the entire surface of the CRT's faceplate.

OBJECTS AND SUMMARY OF THE INVENTION

Accordingly, it is an object of the present invention to compensate for off-axis electron beam defocusing in a CRT either of the single beam, monochrome type or of the multi-beam, color type.

It is another object of the present invention to provide a multi-grid focus lens in a CRT which applies a dynamic electrostatic field to electron beams passing through the lens as the beams are deflected over the CRT's faceplate to correct for off-axis electron beam defocusing.

Yet another object of the present invention is to provide a dynamic voltage to a focus grid in a multi-beam electron gun in a color CRT in synchronism with deflection of the beams over the CRT's faceplate to compensate for off-axis beam defocusing.

A further object of the present invention is to compensate for off-axis electron beam defocusing in a multi-beam electron gun in a prefocus lens portion of the electron gun.

These objects of the present invention are achieved and the disadvantages of the prior art are eliminated by a cathode ray tube (CRT) comprising: a display screen responsive to a beam of electrons incident thereon for providing an image; a source of energetic electrons; a low voltage beam forming arrangement disposed intermediate the display screen and the source of energetic electrons and adjacent the source of energetic electrons for forming the energetic electrons into a beam and directing the beam along an axis of the CRT toward the display screen; a high voltage focus lens disposed intermediate the beam forming arrangement and the display screen on the axis of the CRT for forming a beam electrostatic focus region in the CRT for focusing the electron beam to a spot on the display screen; a magnetic deflection yoke disposed about the focus lens for forming a beam magnetic deflection region for deflecting the electron beam from the axis of the CRT and over the display screen such that the electron beam spot is displaced across the display screen in a raster-like manner, and wherein the beam electrostatic focus region and the beam magnetic deflection region overlap and are coincident; and a dynamic focus correction arrangement in the high voltage focus lens for applying a non-symmetric electrostatic field to the beam, wherein the electrostatic field increases with deflection of the beam from the axis of the CRT to correct for off-axis defocusing of the beam; and wherein the dynamic focus correction arrangement includes a plurality of charged grids disposed in a spaced manner along the axis, and wherein each grid includes a respective beam passing aperture with at least four of said beam passing apertures disposed off-center relative to said axis.

This invention further contemplates an electron gun for use in a cathode ray tube (CRT) for directing a focused electron beam onto a display screen of the CRT, wherein the CRT includes a glass envelope and a magnetic deflection yoke disposed about the glass envelope and forming a beam deflection region for displacing the electron beam across the display screen in a raster-like manner, the electron gun comprising: a source of energetic electrons; a first plurality of co-axially aligned, metallic grids maintained at a relatively low voltage and disposed adjacent the source of energetic electrons for forming the energetic electrons into a beam and directing the beam along an axis of the CRT toward the display screen; a second plurality of grids disposed on the axis intermediate the first plurality of metallic grids and the display screen and adjacent the magnetic deflection yoke, wherein the second plurality of grids are maintained at a relatively high voltage and form a main focus lens with a beam focus region for focusing the electron beam on the display screen, wherein the beam deflection and beam focus regions are coincident and the electron beam is simultaneously magnetically deflected and electrostatically focused, and wherein at least one of the second plurality of grids is disposed on or in close proximity to an inner surface of the CRT's glass envelope; and a third plurality of grids disposed on the axis adjacent the second plurality of grids for applying a dynamic non-symmetric electrostatic field to the electron beam, wherein the electrostatic field increases in strength with increasing deflection of the electron beam from the axis for correcting for off-axis defocusing of the electron beam, and wherein each of the third plurality of grids includes a respective beam passing aperture with at least four of the beam passing apertures disposed off-center relative to the axis.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIGS. 6*b*–6*d* are elevation views of various charge grids in the deflection lens of the electron gun of FIG. 6*a;*

FIG. 11*b*–11*d* are elevation views of various charge grids in the deflection lens of the electron gun of FIG. 11*a;*

FIGS. 13*b*–13*d* are elevation views of various charge grids in the deflection lens of the electron gun of FIG. 13*a;*

FIGS. 26*a*–26*e* are elevation views of various charged girds in the deflection lens electron gun of FIG. 26;

DETAILED DESCRIPTION OF THE PREFERRED EMBODIMENTS

Figure 5:
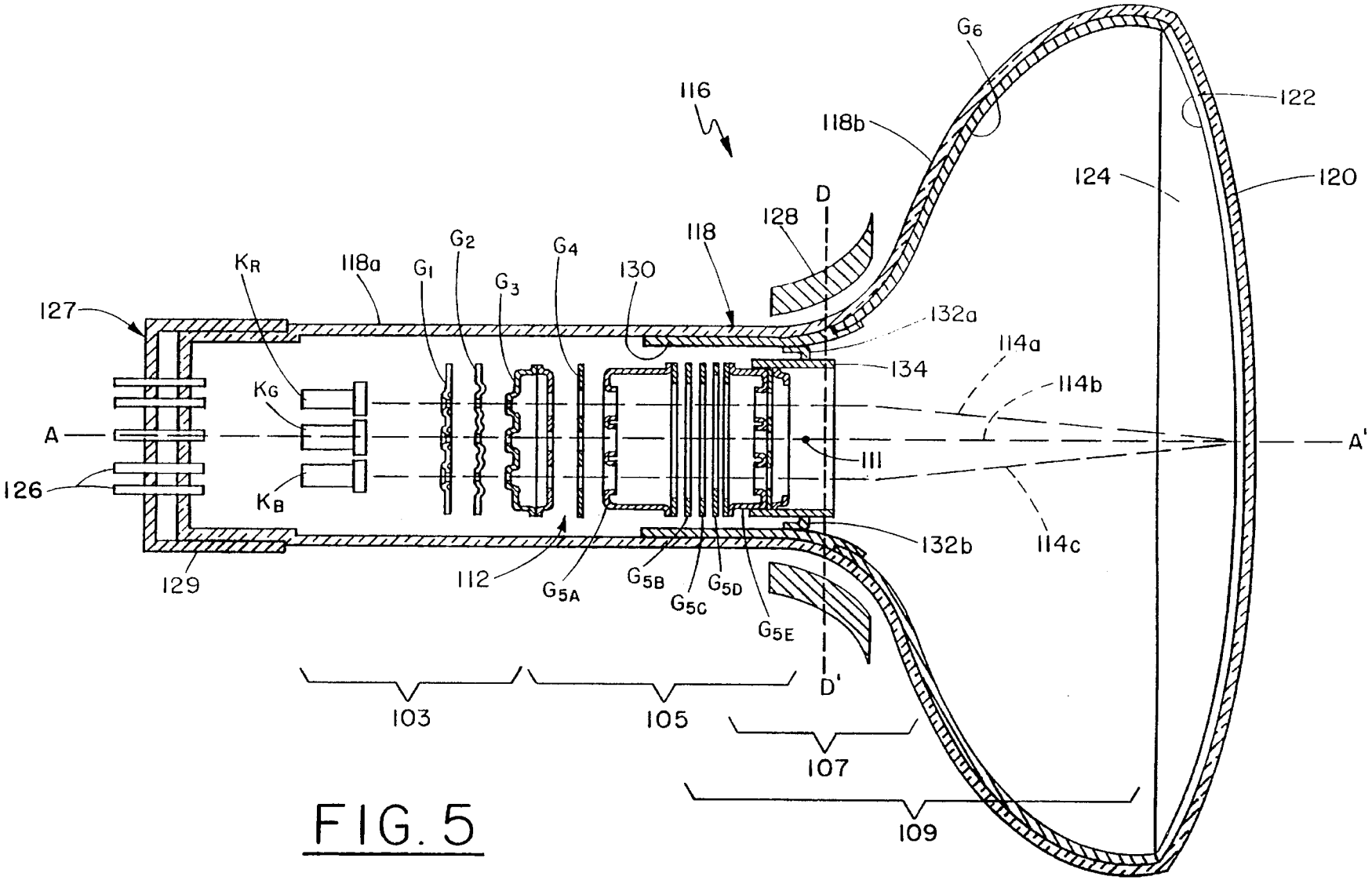
FIG. 5 is a longitudinal sectional view of a multi-beam deflection lens CRT incorporating dynamic off-axis defocusing correction in accordance with the principles of the present invention.

Referring to FIG. 5, there is shown a longitudinal sectional view of a color CRT 116 incorporating dynamic off-axis defocusing correction in accordance with the principles of the present invention. Before beginning a detailed description of the present invention, it should be emphasized that although the electron gun 112 incorporated in CRT 116 and described in detail below includes $G_1$–$G_6$ charged grids, the present invention is not limited to use in this type of electron gun, but may be employed in virtually any type of electron gun incorporating a deflection focus lens. In addition, while the present invention is described as incorporated in a multi-beam color CRT, this invention will operate equally as well in a single beam monochrome CRT. Finally, the term "grid" used in the following discussion is also intended to mean "electrode" or "plate" as commonly used in CRT terminology.

Figure 1:
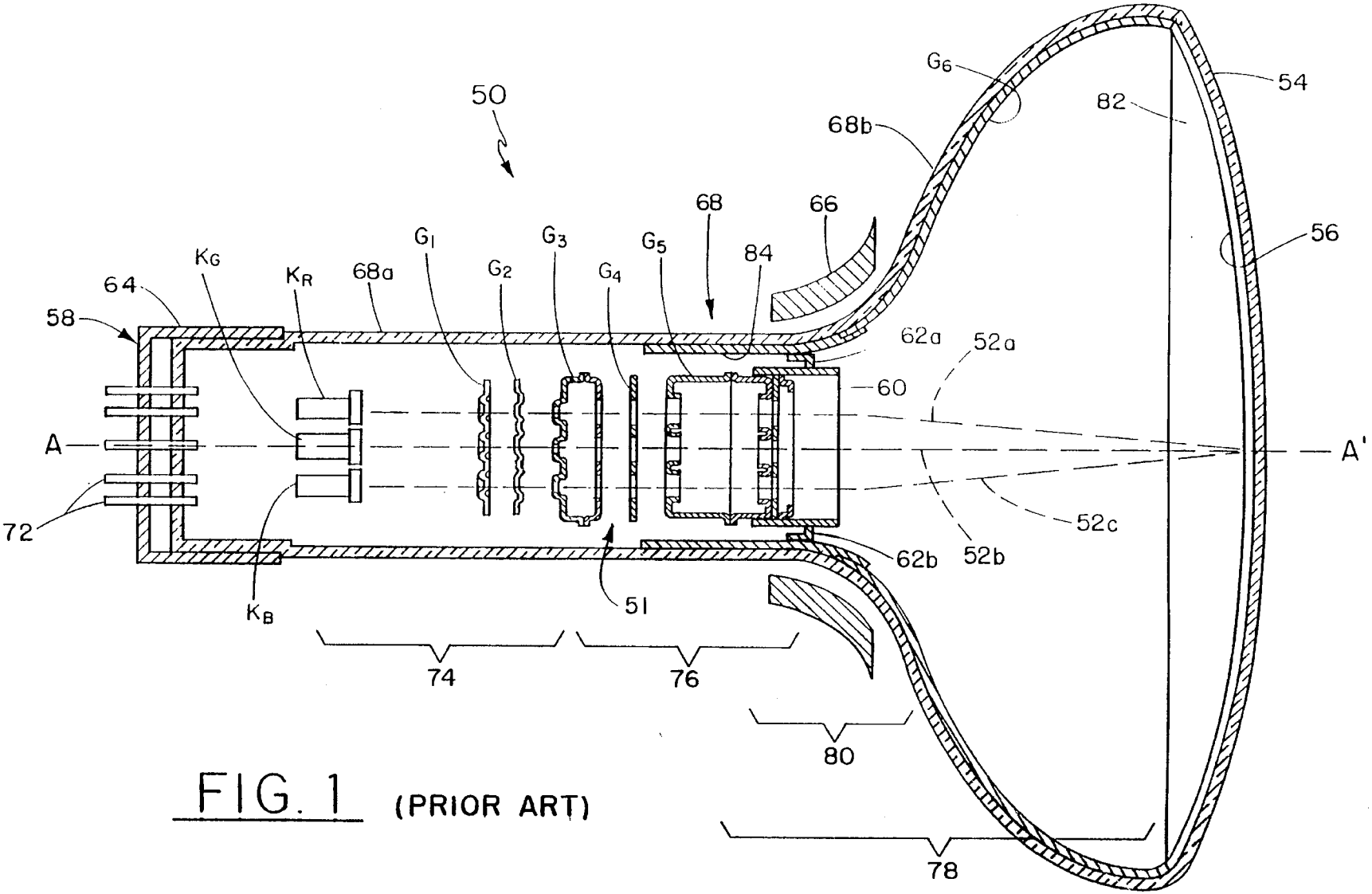
FIG. 1 (PRIOR ART)
FIG. 1 is a longitudinal sectional view of a prior art deflection lens CRT with which the present invention is intended for use.
Figure 2:
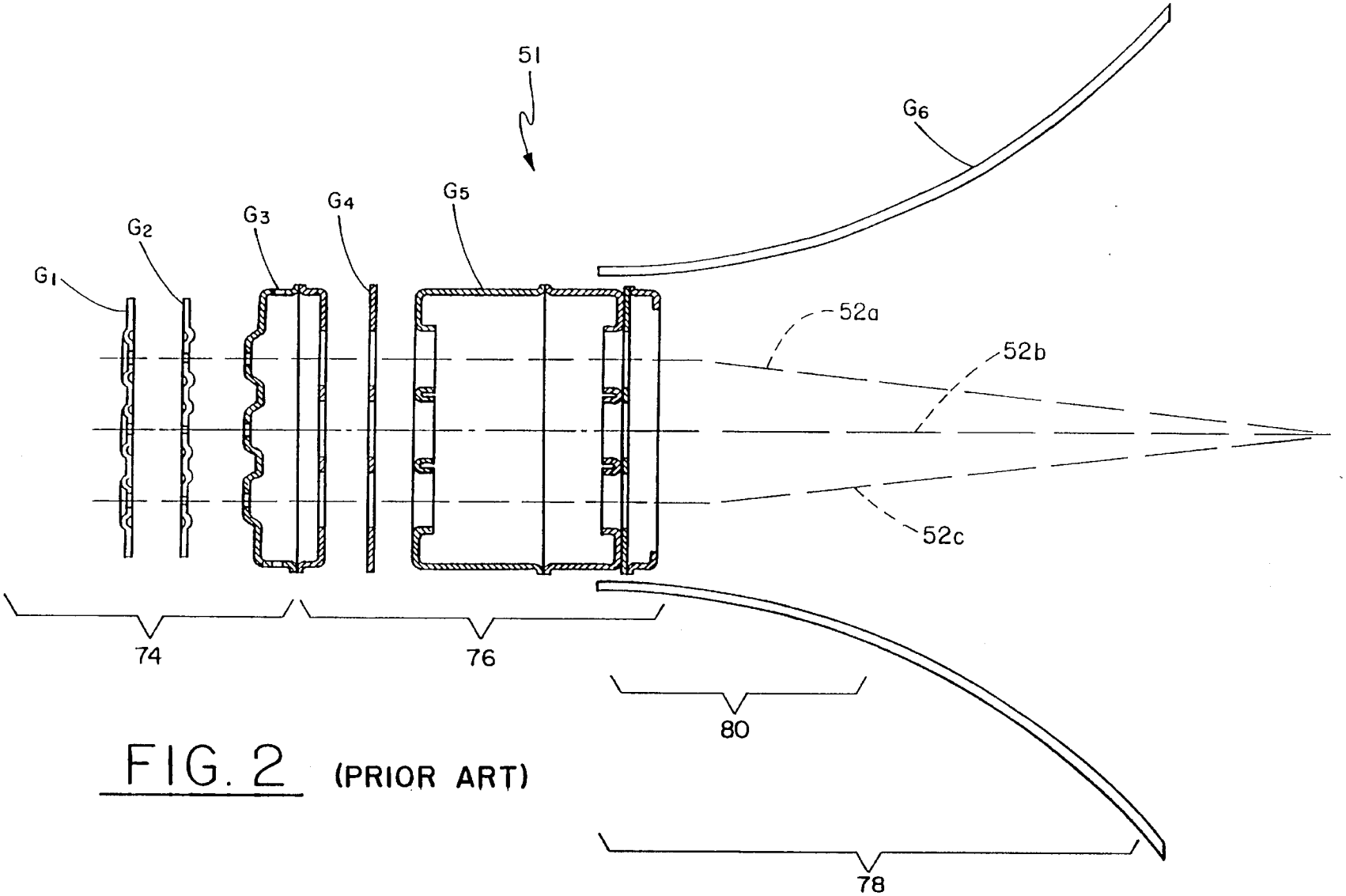
FIG. 2 (PRIOR ART)
FIG. 2 is a simplified longitudinal sectional view of the multi-grid electron gun employed in the three electron beam deflection lens CRT of FIG. 1.
Figure 4:
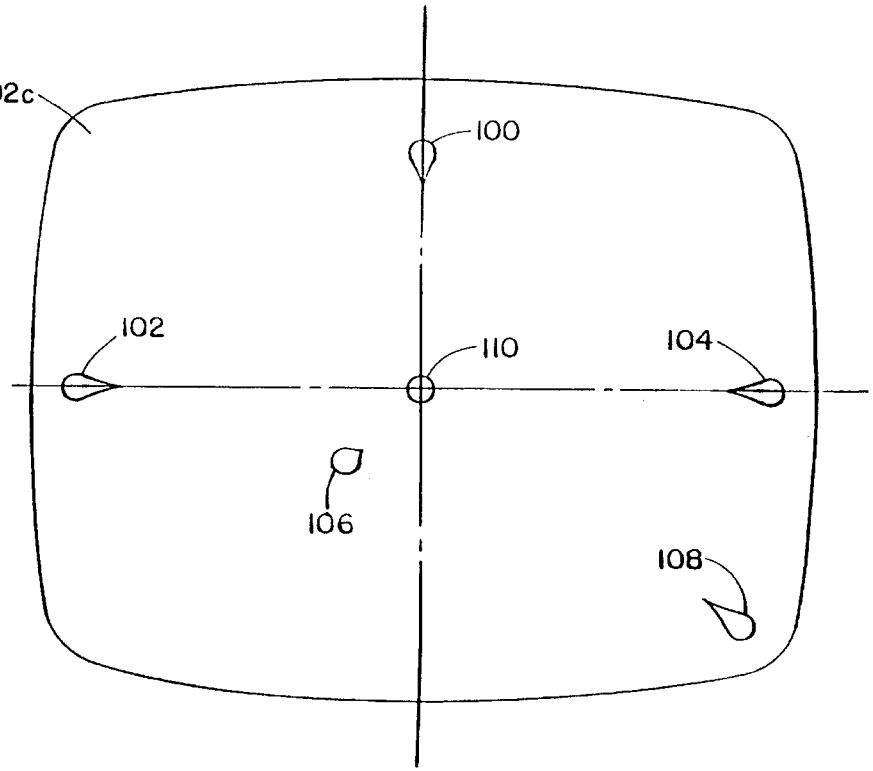
FIG. 4 (PRIOR ART)
FIG. 4 is a plan view of a CRT display screen illustrating distortion of electron beam spot on the display screen arising from off-axis deflection of the electron beam.
Figure 6A:
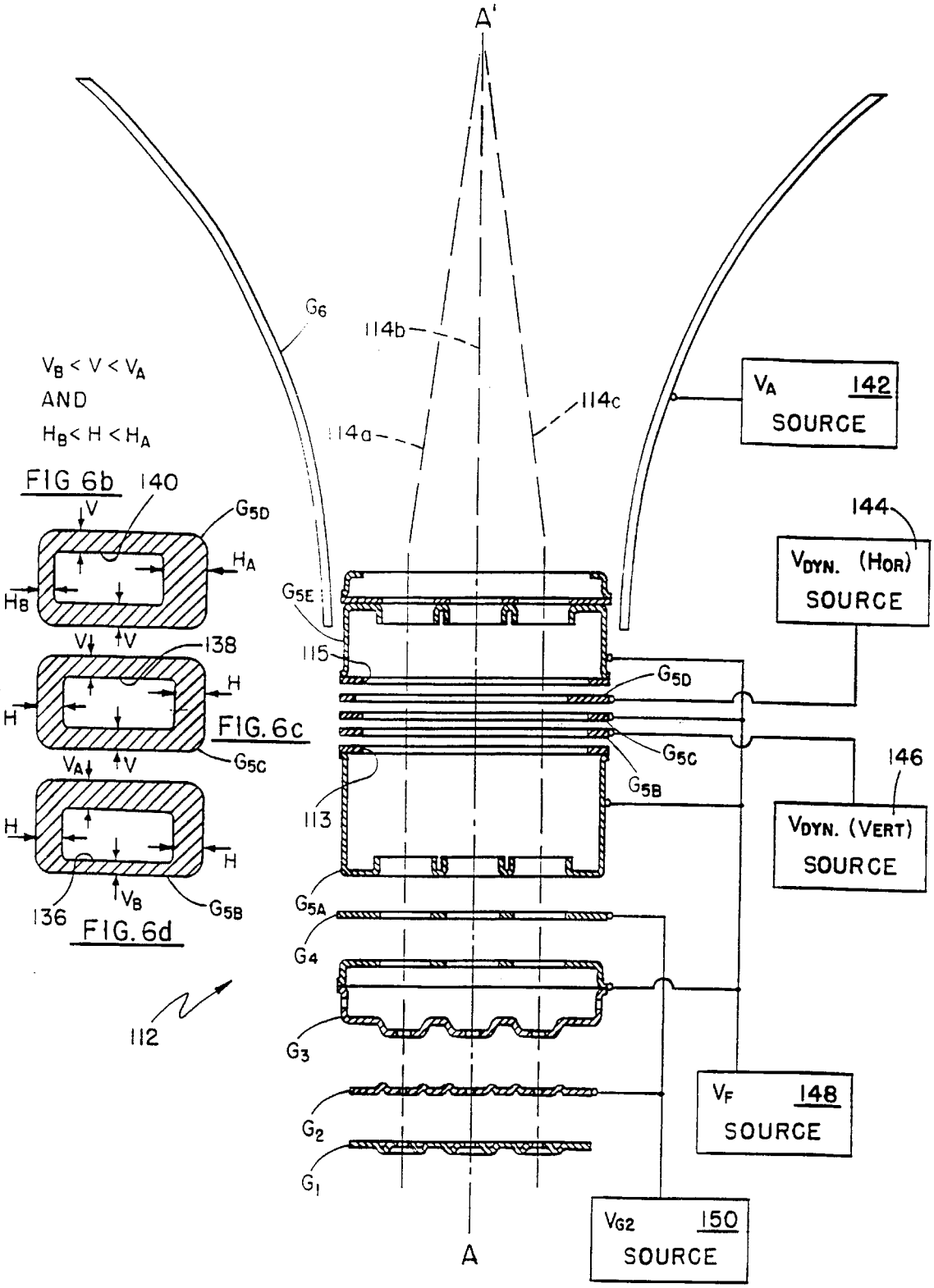
FIG. 6*a* is a simplified longitudinal sectional view of the multi-grid electron gun employed in the deflection lens CRT of FIG. 5 showing additional details of the electron gun.

As in the prior art CRT shown in FIG. 1, the inventive electron gun 112 in CRT 116 includes a plurality of cathodes $K_R$, $K_G$ and $K_B$ for respectively generating the primary color electron beams of red, green and blue. Each of the three cathodes $K_R$, $K_G$ and $K_B$ is heated so as to emit energetic electrons into a low voltage beam forming region (BFR) 103 comprised of a $G_1$ control grid, a $G_2$ screen grid and a facing portion of a $G_3$ grid. Various of the grids in electron gun 112 are coupled to an appropriate voltage source as shown in the sectional view of electron gun 112 in FIG. 6 for charging the grids to a desired potential. Typically, cathodes $K_R$, $K_G$ and $K_B$ operate at approximately 150 V, the $G_1$ control grid at ground potential, and the $G_2$ screen grid at approximately 600 V. The $G_3$ grid is typically electrically interconnected to a $G_5$ grid and operates at about 7 kV and the $G_2$ grid is typically electrically interconnected to a $G_4$ grid. Thus, as shown in FIG. 6, the $G_2$ and $G_4$ grids are coupled to a $V_{G2}$ voltage source 150. Each of the $G_1$, $G_2$ and $G_3$ grids includes at least one set of three inline apertures, where each aperture is disposed along an electron beam axis for passing a respective one of the electron beams 114*a*, 114*b* and 114*c* toward the phosphor coating 122 on an inner surface of the CRT's display screen 120.

Disposed about electron gun 112 in a sealed manner is a glass envelope 118. The CRT glass envelope 118 includes a generally cylindrical neck portion 118*a* and a frusto-conical funnel portion 118*b*. The aforementioned glass faceplate 120 is disposed on the large end of the funnel portion 118*b* of the CRT's glass envelope 118. A charged, apertured shadow mask 124 is disposed adjacent the CRT's faceplate 120 and serves as a color selection grid, ensuring that each of the three electron beams lands only on its assigned phosphor elements, or deposits. Disposed in a sealed manner on an aft portion of the glass envelope's neck portion 118*a* is a plug-like connector 127 comprised of a plastic housing 129 in a plurality of conductive pins 126 extending in a sealed manner through the glass envelope for providing various voltages and signals to the CRT components located therein.

In addition to the low voltage BFR 103 described above, electron gun 112 includes, in proceeding toward the CRT's faceplate 120, a prefocus lens 105 and a deflection focus lens 109. Prefocus lens 105 includes a $G_4$ grid, a facing portion of the adjacent $G_3$ grid, and $G_{5A}$–$G_{5E}$ grids. The $G_{5A}$ grid (or the $G_5$ lower grid) is generally cup-shaped as is the $G_{5E}$ (or $G_5$ upper) grid. The $G_{5A}$ grid includes three aligned apertures in facing relation to the three cathodes $K_R$, $K_B$ and $K_B$. The $G_{5E}$ grid similarly includes three inline apertures in facing relation to the CRT's faceplate 120. The $G_{5A}$ and $G_{5E}$ grids further include respective common apertures 113 and 115 in facing relation through which the three electron beams transit. The $G_{5B}$, $G_{5C}$ and $G_{5D}$ grids are each generally planar and rectangular in shape and have respective common apertures 136, 138 and 140 as shown in the left-hand portion of FIG. 6.

Electron gun 112 further includes a $G_6$ grid which, in combination with the $G_{5A}$–$G_{5E}$ grids focuses the three electron beams 114*a*, 114*b* and 114*c* on the CRT's faceplate 120. The $G_6$ grid is disposed immediately adjacent to or on the inner surface of the frusto-conical funnel portion 118*b* of the CRT's glass envelope 118. In the embodiment shown in FIG. 5, the $G_6$ grid is in the form of a conductive coating deposited on the inner surface of the glass envelope 118 in an annular shape symmetrical about the CRT's longitudinal axis A–A'. The $G_6$ grid is preferably in the form of a metallic or carbon-based coating comprised of any of a variety of conventional conductive coating compositions well known to those skilled in the relevant art. The $G_6$ grid preferably extends from a forward portion of the CRT's glass envelope 118 rearward to a location within a deflection yoke 128 disposed about the CRT 116. The $G_6$ grid is electrically coupled to an anode voltage $V_A$ source 142 via an anode button extending through the glass envelope which is not shown in the figures for simplicity. A resistive coating 130 is deposited on an inner portion of the glass envelope 118 so as to extend from the envelope's neck portion 118*a* to its frusto-conical funnel portion 118*b*. Resistive coating 130 is disposed over an aft portion of the $G_6$ grid and provides a high impedance current leakage path for preventing high voltage arcing between the $G_{5E}$ grid and a support cup 134 combination and the $G_6$ conductive coating grid. The support (or convergence) cup 134 is coupled to the high side (toward the CRT's faceplate 120) of the $G_{5E}$ grid and includes a plurality of bulb spacers, two of which are shown in FIG. 5 as elements 132*a* and 132*b*. Bulb spacers 132*a* and 132*b* are disposed in a spaced manner about the outer periphery of support cup 134 and engage the resistive coating 130. The combination of support cup 134 and bulb spacers 132*a*, 132*b* provide support for the $G_{5E}$ grid and the upper end of electron gun 112. The remaining grids in electron gun 112 are maintained in position and in common alignment in a conventional manner by means of a plurality of glass rods extending the length of the electron gun which also are not shown in the figures for simplicity.

Disposed about the CRT's glass envelope 118 between its neck portion 118*a* and its frusto-conical funnel portion 118*b* is the aforementioned magnetic deflection yoke 128. Magnetic deflection yoke 128 is conventional in design and operation and includes a generally toroidal-shaped core typically comprised of ferrite material and a large number of electrical conductor windings disposed about the core for producing a magnetic field within the CRT 116 in the vicinity where the three electron beams 114*a*, 114*b* and 114*c* leave the $G_{5E}$ grid and travel toward the faceplate 120. Deflection yoke 128 displaces the electron beams in unison over the display screen 120 in a raster-like manner as previously described. Deflection yoke 128 forms a beam deflection region 107 characterized as having an electron beam deflection center located on line D–D' within CRT 116.

With the $G_{5E}$ grid and the $G_6$ conductive coating grid extending into or immediately adjacent to the magnetic deflection yoke 128, focusing of the three electron beams 114*a*, 114*b* and 114*c* by the deflection focus lens 109 is performed within a beam focus region which is co-located with the beam deflection region 107. The three electron beams 114*a*, 114*b* and 114*c* are therefore simultaneously and coincidentally focused and deflected within CRT 116. With the deflection center of the three electron beams located on the beam deflection centerline D–D' the focal point of the deflection focus lens 109 comprised of the $G_{5E}$ and $G_6$ grids can be represented as a point 111 on axis A–A'. The electron beam deflection center is thus located within the focal point 111 of the deflection focus lens 109 for increased electron beam deflection sensitivity. Colocating the focus and deflection regions within CRT 116 is accomplished by either moving the beam focus region toward faceplate 120, or by moving the beam deflection region toward the neck portion 118*a* of the CRT's glass envelope 118. Colocating the focus and deflection regions within CRT 116 also allows for shortening the length of the CRT. Positioning the $G_6$ grid on or in close proximity to the inner surface of the CRT's glass envelope 118 also increases the diameter of the electron gun's main focus lens. By increasing the effective size of the main focus lens, electron beam spherical aberration is reduced and electron beam spot size on the CRT's faceplate 120 is improved. While the $G_6$ grid is preferably in the form of a conductive coating disposed on the inner surface of the frusto-conical funnel portion 118*b* of the CRT's glass envelope 118, the $G_6$ grid may assume other forms. For example, the $G_6$ electrode may be in the form of a frusto-conical-shaped thin metallic grid disposed on or in closely spaced relation to the inner surface of the glass envelope's funnel portion 118*b*. The frusto-conical metal grid may be maintained in position by various means such as an appropriate attachment coating well known to those skilled in the relevant art for maintaining the metallic grid in position within CRT 116.

With reference specifically to FIG. 6, details of the dynamic off-axis defocusing correction provided by the present invention will now be described. As described above and as shown in FIG. 6, the $G_2$ and $G_4$ grids are connected to and charged by a $V_{G2}$ source 150. Similarly, the $G_3$, $G_{5A}$ and $G_{5E}$ grids are coupled to and charged by a focus voltage ($V_F$) source 148. The common aperture 138 of the $G_{5C}$ grid is in vertical and horizontal alignment with the respective common apertures 113 and 115 of the $G_{5A}$ and $G_{5E}$ grids. In addition, the common aperture 138 in the $G_{5C}$ grid is of essentially the same height and width as the respective common apertures 113 and 115 in the $G_{5A}$ and $G_{5E}$ grids.

As shown in the left-hand portion of FIG. 6 which is a front elevation view of the $G_{5B}$, $G_{5C}$ and $G_{5D}$ grids, the common aperture 138 of the $G_{5C}$ grid is of essentially the same height and width as the respective common apertures 136 and 140 of the $G_{5E}$ and $G_{5D}$ grids. However, in accordance with the present invention, the common apertures 136 and 140 of the $G_{5B}$ and $G_{5D}$ grids are off-center from the axis A–A' of electron gun 112 and CRT 116. Thus, aperture 136 is disposed in a lower portion of the $G_{5E}$ grid than the corresponding apertures 138 and 140 in the $G_{5C}$ and $G_{5D}$ grids. More specifically, the dimensions of those portions of the $G_{5C}$ and $G_{5D}$ grids disposed above and below the respective apertures 138 and 140 therein is given by the value V. The dimension of the portion of the $G_{5B}$ grid above the aperture 136 therein is given by the value $V_A$, while the dimension of the portion of the grid below the aperture is given by the value $V_B$, where $V_B<V<V_A$. Similarly, the dimensions of the portion of the $G_{5B}$ and $G_{5C}$ grids laterally relative to the respective apertures 136 and 138 therein is given by the value H. In the case of the $G_{5D}$ grid, the dimension of the portion of the grid to the left of aperture 140 is $H_B$, while the dimension of the portion of the grid to the right of the aperture is $H_A$, where $H_B<H<H_A$. Aperture 136 in the $G_{5B}$ grid is vertically off-center, while aperture 140 in the $G_{5D}$ grid is horizontally off-center relative to the electron gun's longitudinal axis A–A'. When the $G_{5B}$ and $G_{5D}$ grids are biased by a proper voltage, the off-center positioning of beam passing apertures 136 and 140 respectively provide vertical and horizontal defocusing correction for electron beams 114*a*, 114*b* and 114*c* when deflected off-axis. By coupling the $G_{5B}$ grid to a first variable voltage source, or $V_{DYN}$(VERT) source, 146 and coupling the $G_{5D}$ grid to a second variable voltage source, or $V_{DYN}$(HOR) source, 144, dynamic off-axis defocusing correction is provided. Thus, as electron beam deflection increases toward an edge of the CRT's faceplate, the voltage difference between either the $G_{5B}$ grid or the $G_{5D}$ grid (or both) and the focus voltage of the grids on each side of the $G_{5B}$ and $G_{5D}$ grids increases. The electrostatic lens force on the electron beam, or the focusing correction effect, can be either positive or negative depending upon the relative voltage difference between the off-axis apertured grid and the adjacent on-axis apertured grid. Thus, by changing the relative voltages of adjacent grids, an over-focusing or an under-focusing effect may be introduced in the electron beams as they are deflected off-axis. Because the magnitude of the difference between the off-axis apertured grid dynamic voltage and the on-axis apertured grid fixed voltage may be changed as a function of electron beam deflection, a constantly changing defocusing correction factor may be applied to each of the three electron beams 114*a*, 114*b* and 114*c* in both the horizontal and vertical directions. Reversing the polarity of adjacent grids will result in a reversal in the defocusing compensation such as from left to right or from up to down.

Figure 7:
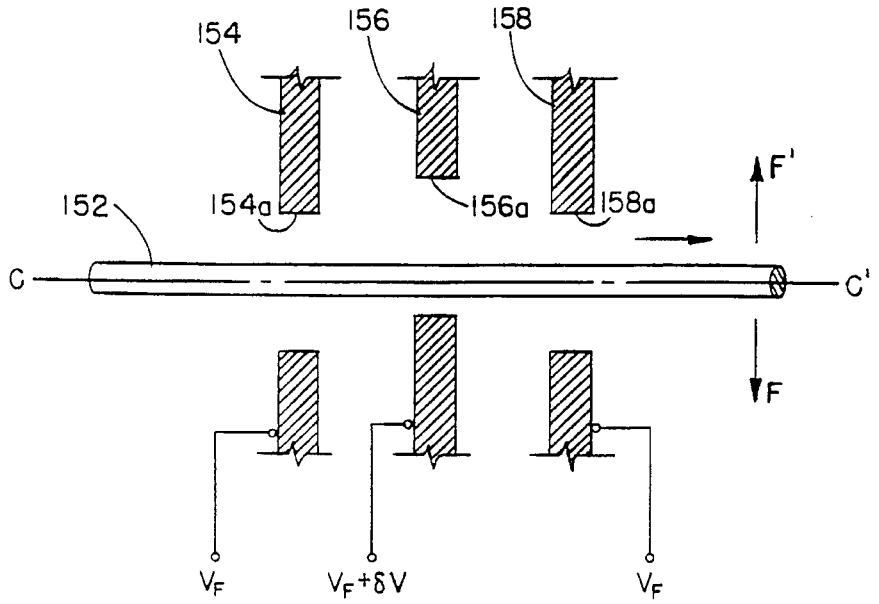
FIG. 7 is a simplified schematic diagram illustrating the transit of an electron beam through a charged grid arrangement in accordance with the present invention.

Referring to FIG. 7, there is shown a simplified schematic diagram illustrating the transit of an electron beam 152 through a charged grid arrangement in accordance with the present invention. Electron beam 152 is directed along axis C–C' in the direction of the arrow through respective apertures 154*a*, 156*a* and 158*a* in charged grids 154, 156 and 158. The beam passing apertures 154*a* and 158*a* of grids 154 and 158 are centered on axis C–C' while the beam passing aperture 156*a* of grid 156 is centered above axis C–C'. A dynamic beam focusing effect may be realized by applying a fixed focus voltage $V_F$ to grids 154 and 158 and a dynamic focus voltage $V_F+\delta V$ to grid 156. When $\delta V$ is positive rendering the voltage $V_F+\delta V>V_F$, a downward force F is applied to electron beam 152. Similarly, if $\delta V$ is negative, the sum $V_F+\delta V<V_F$ and an upward force F' is applied to electron beam 152. Thus, by changing the sign as well as the magnitude of $\delta V$, a continuously varying off-axis defocusing correction force may be applied to electron beam 152 as it is deflected over the CRT's display screen. The off-axis defocusing correction force may be broken up into a vertical and a horizontal component as the electron beam is deflected above and below the display screen's horizontal center line and to the right and left of the display screen's vertical center line.

Figure 8A:
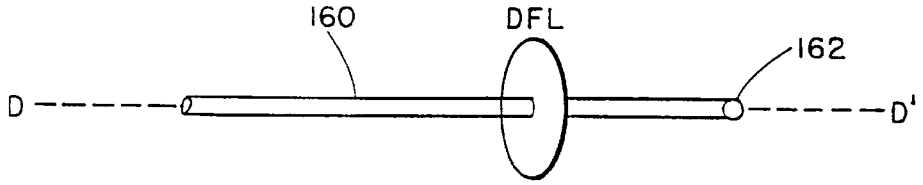
FIGS. 8*a*, 8*b* and 8*c* are simplified schematic diagrams illustrating electron beam off-axis defocusing and the manner in which this defocusing is corrected by the present invention.
Figure 8B:
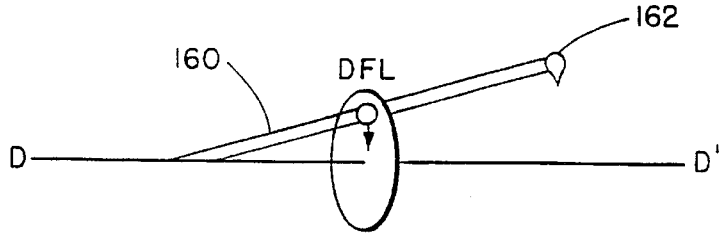
Figure 8C:
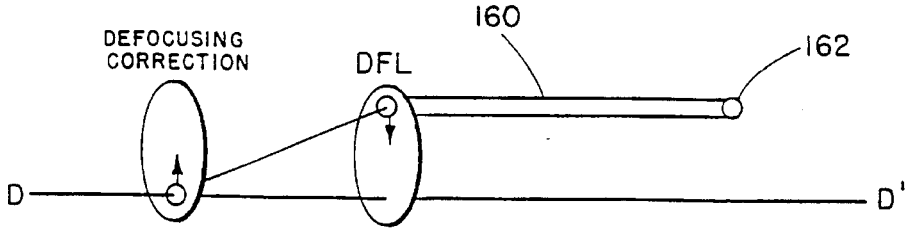

Referring to FIGS. 8*a*, 8*b* and 8*c*, there are shown simplified schematic diagrams illustrating electron beam off-axis defocusing and the manner in which this defocusing is corrected by the present invention. In FIG. 8*a*, electron beam 160 is directed along the CRT's axis D–D' and is undeflected. In this case, electron beam 160 produces a circular electron beam spot 162 on the CRT's display screen. FIG. 8*b* shows electron beam 160 deflected above axis D–D' as it passes through the deflection lens (DFL) in the CRT. Deflection of electron beam 160 above axis D–D' results in a teardrop-shaped electron beam spot 162 with a downward directed tail on the CRT's display screen. FIG. 8*c* shows the effect of the dynamic off-axis defocusing correction of the present invention on the upwardly deflected electron beam 160. As shown in FIGS. 8*b* and 8*c*, upward deflection of the electron beam 160 results in a downwardly directed force applied to the beam as it transits the DFL. FIG. 8*c* shows an upwardly directed defocusing correction force applied to the electron beam 160 before it reaches the DFL resulting in formation of a circular electron beam spot 162 on the CRT's display screen. The present invention thus exerts a dynamic off-axis defocusing correction force on the electron beam before it reaches the CRT's DFL and experiences an off-axis dependent defocusing force to provide a circular electron beam spot on the display screen.

Figure 9:
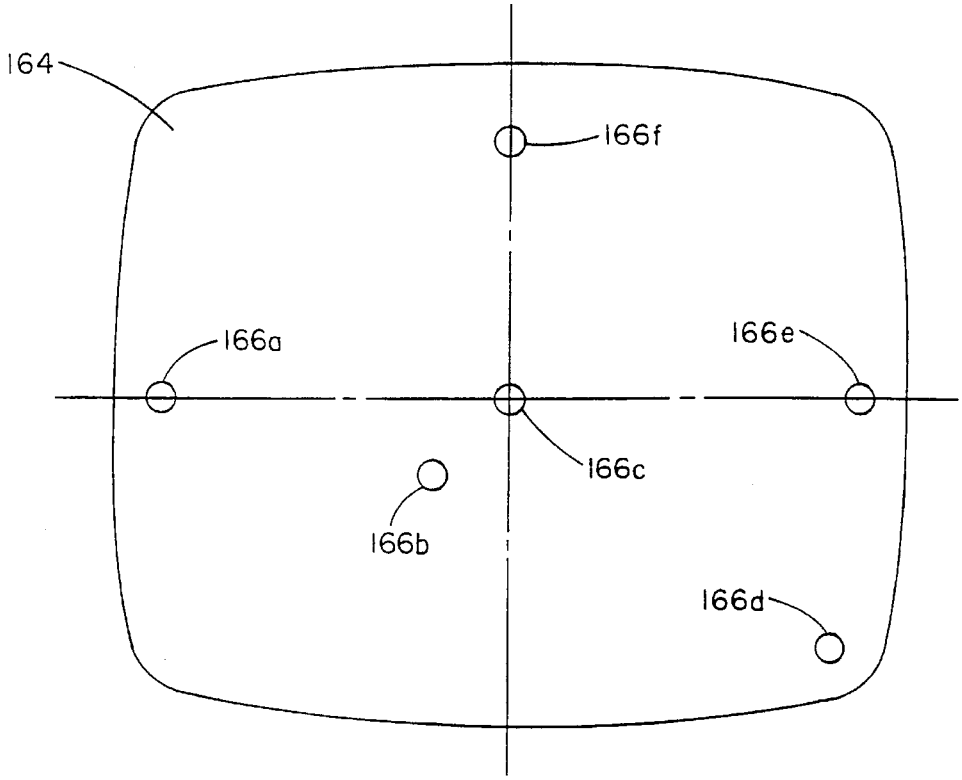
FIG. 9 is a plan view of a CRT display screen showing electron beam spots at various locations on the display screen where off-axis beam defocusing has been corrected by the present invention.

Referring to FIG. 9, there is shown a plan view of a CRT display screen 164 illustrating a plurality of electron beam spots 166*a–f* at various locations on the display screen. The electron beam spots 166*a–f* on display screen 164 represent the circular spot shape at all locations on the display screen 164 available through the dynamic off-axis defocusing correction of the present invention.

Figure 10:
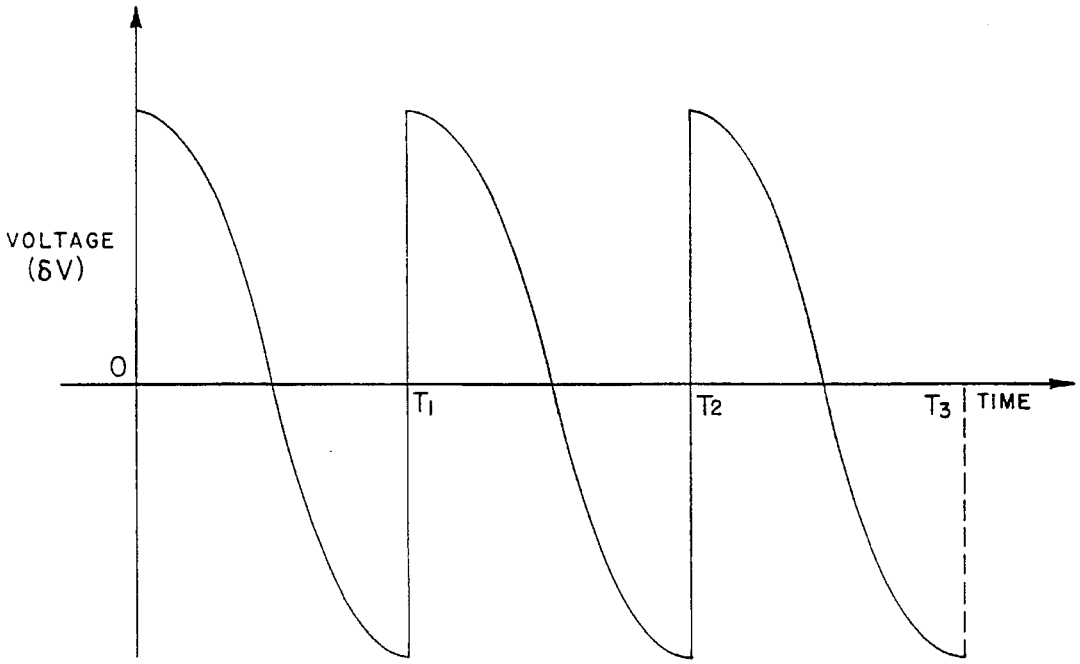
FIG. 10 is a graphic illustration of the variation of correction voltage with time applied to a focusing grid having an off-axis beam passing aperture in the electron gun in accordance with the present invention.

Referring to FIG. 10, there is shown a graphic illustration of the variation of correction voltage with time applied to a focusing grid such as grid 156 in FIG. 7 having an off-axis beam passing aperture 156*a* in accordance with the present invention. One horizontal scan of the display screen by the electron beam occurs during the time intervals $T_1$, $T_2-T_1$, and $T_3-T_2$. The voltage $\delta V$ on grid 156 is referenced to the voltages on adjacent grids 154 and 158 in FIG. 7. From FIG. 10, it can be seen that $\delta V$ goes from a maximum positive value at the start of horizontal deflection (maximum deflection) through a value of zero when the beam is undeflected, to a maximum negative value at full beam deflection. Retrace occurs at $T_1$ and another deflection cycle is initiated. The voltage applied to the charged grid having an off-center aperture is $V_F+\delta V$ which varies from maximum values at full beam deflection at opposed edges of the display screen to a value of zero when the beam is undeflected and is aligned along the CRT's longitudinal axis. Although not shown in FIG. 7 for simplicity, a vertical correction voltage having a periodic waveform is applied to a grid having a vertically offset aperture to correct for beam defocusing during vertical deflection. The vertical focus correction voltage waveform is somewhat similar to that shown in FIG. 10 for the horizontal focus correction voltage, but will have a longer period than the waveform shown in FIG. 10.

Figure 11A:
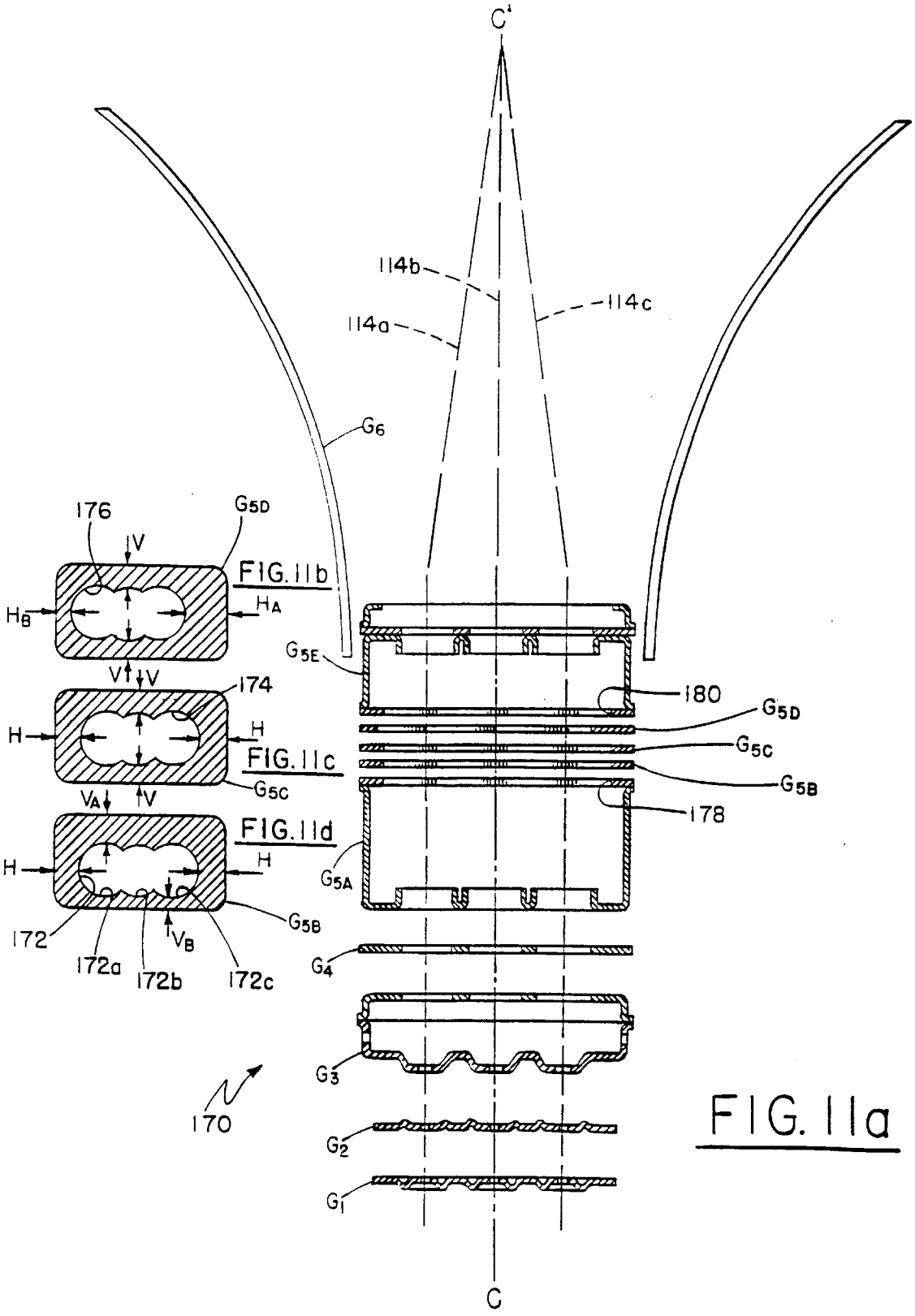
FIG. 11*a* is a simplified longitudinal sectional view of another embodiment of a multi-grid electron gun for use in a deflection lens CRT in accordance with the present invention.

Referring to FIG. 11, there is shown a simplified longitudinal sectional view of a multi-beam electron gun 170 containing chain link-shaped common apertures in some of the grids in the electron gun in accordance with another embodiment of the present invention. Electron gun 170 is adapted to form, accelerate and focus three inline electron beams 14*a*, 14*b* and 14*c* on a CRT's display screen (not shown for simplicity). Electron gun 170 includes $G_1$, $G_2$, $G_3$ and $G_4$ grids essentially identical in configuration and operation to those corresponding grids in the electron gun 112 of FIG. 6 described above. Electron gun 170 further includes $G_{5A}$, $G_{5B}$, $G_{5C}$, $G_{5D}$ and $G_{5E}$ grids arranged in a spaced manner along the electron gun axis C–C'. All of the charged grids in electron gun 170 are connected to voltage sources as previously described with respect to electron gun 112 in FIG. 6, with the voltage sources omitted from FIG. 11 for simplicity.

As shown in the left-hand portion of FIG. 11 which is a front elevation view of the $G_{5B}$, $G_{5C}$ and $G_{5D}$ grids, these three grids have respective chain link-shaped common apertures 172, 174 and 176 through which the three electron beams 114*a*, 114*b* and 114*c* pass. In addition, common aperture 178 in the $G_{5A}$ grid in facing relation with the $G_{5B}$ grid is also chain link-shaped as is the common aperture 180 in the $G_{5E}$ grid which is in facing relation with the $G_{5D}$ grid. As shown for the case of the common chain link-shaped aperture 172 in the $G_{5B}$ grid, each of the chain link-shaped apertures includes a pair of outer arcuate-shaped portions 172*a* and 172*c* and a center arcuate portion 172*b*. The outer and center arcuate portions of on-axis chain link-shaped apertures 178 in the $G_{5A}$ grid, 174 in the $G_{5C}$ grid, and 180 in the $G_{5D}$ grid are all aligned with a respective electron beam axis. In addition, as shown for the case of the common chain link-shaped aperture 174 in the $G_{5C}$ grid, the vertical dimensions of those portions of the $G_{5A}$, $G_{5C}$ and $G_{5E}$ grids disposed above and below the respective apertures 178, 174 and 180 therein is given by the value V. The dimensions of those portions of the $G_{5A}$, $G_{5C}$ and $G_{5E}$ grids disposed laterally to the left and right of the respective apertures 178, 174 and 180 therein is given by the value H.

The dimension of the portion of the $G_{5B}$ grid above chain link-shaped aperture 172 therein is given by the value $V_A$, while the dimension of the portion of the grid below the aperture is given by the value $V_B$, where $V_B<V<V_A$. Aperture 172 is thus centered below the electron gun's axis C–C'. The dimensions of those portions of the $G_{5B}$ and $G_{5C}$ grids disposed laterally relative to the respective apertures 172 and 174 therein is given by the value H. In the case of the $G_{5D}$ grid, the dimension of the portion of the grid to the left of the common chain link-shaped aperture 176 is $H_B$, while the dimension of the portion of the grid to the right of the aperture is $H_A$, where $H_B<H<H_A$. Aperture 176 is thus centered to the left of the electron gun's axis C–C'. Aperture 172 in the $G_{5B}$ grid is thus vertically off-center, while aperture 176 in the $G_{5D}$ grid is horizontally off-center relative to the electron gun's longitudinal axis C–C'. When the $G_{5E}$ and $G_{5D}$ grids are biased by a proper voltage as described above with respect to electron gun 112 in FIG. 6, the off-center positioning of beam passing apertures 172 and 176 respectively provide vertical and horizontal defocusing correction for electron beams. 114*a*, 114*b* and 114*c* when deflected off-axis. By coupling the $G_{5B}$ grid to a first variable voltage source (not shown) and coupling the $G_{5D}$ grid to a second variable voltage source (also not shown), dynamic off-axis defocusing correction is provided.

The common chain link-shaped apertures 172, 174 and 176 respectively disposed in the $G_{5B}$, $G_{5C}$ and $G_{5D}$ grids each include horizontally spaced, vertically enlarged portions for correcting for vertical spherical aberration in each of the three electron beams. Increasing the vertical dimension of that portion of each of the common lens apertures aligned with or positioned adjacent to a respective electron beam reduces the vertical spot size of the electron beam without degrading other electron gun operating characteristics. Additional details of the operation and configuration of the aforementioned common chain link-shaped apertures in the charged grids of an electron gun main focus lens are provided in co-pending application, Ser. No. 07/890,836, entitled "Hollow Chain Link Main Lens Design for Color CRT," filed Jun. 1, 1992 in the name of the present inventor and assigned to the present assignee. The disclosure and claims of the aforementioned allowed co-pending application are hereby incorporated by reference in the present application.

Figure 12:
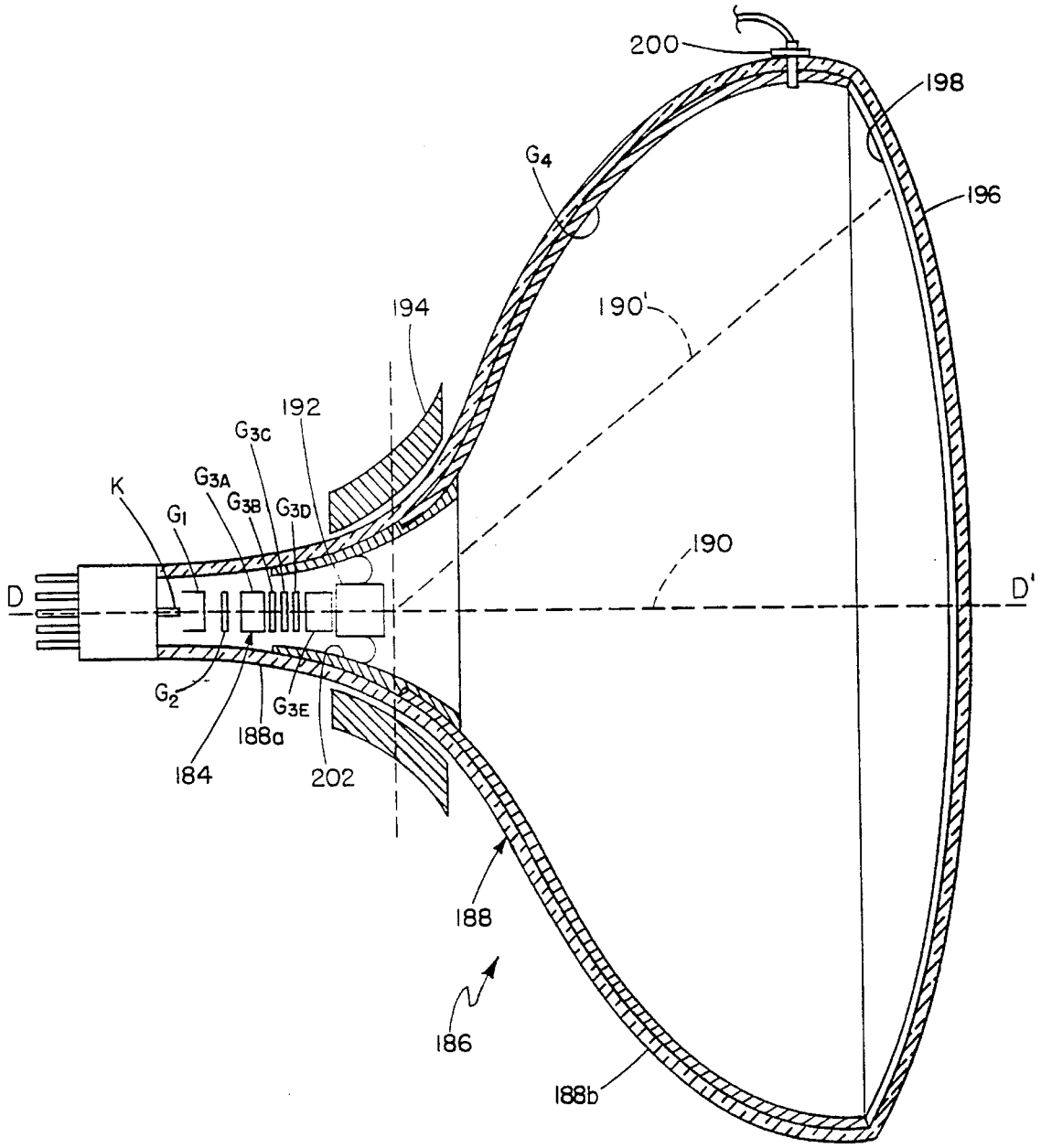
FIG. 12 is a longitudinal sectional view of a single beam deflection lens in a monochrome CRT incorporating dynamic off-axis defocusing correction in accordance with the principles of the present invention.
Figure 13A:
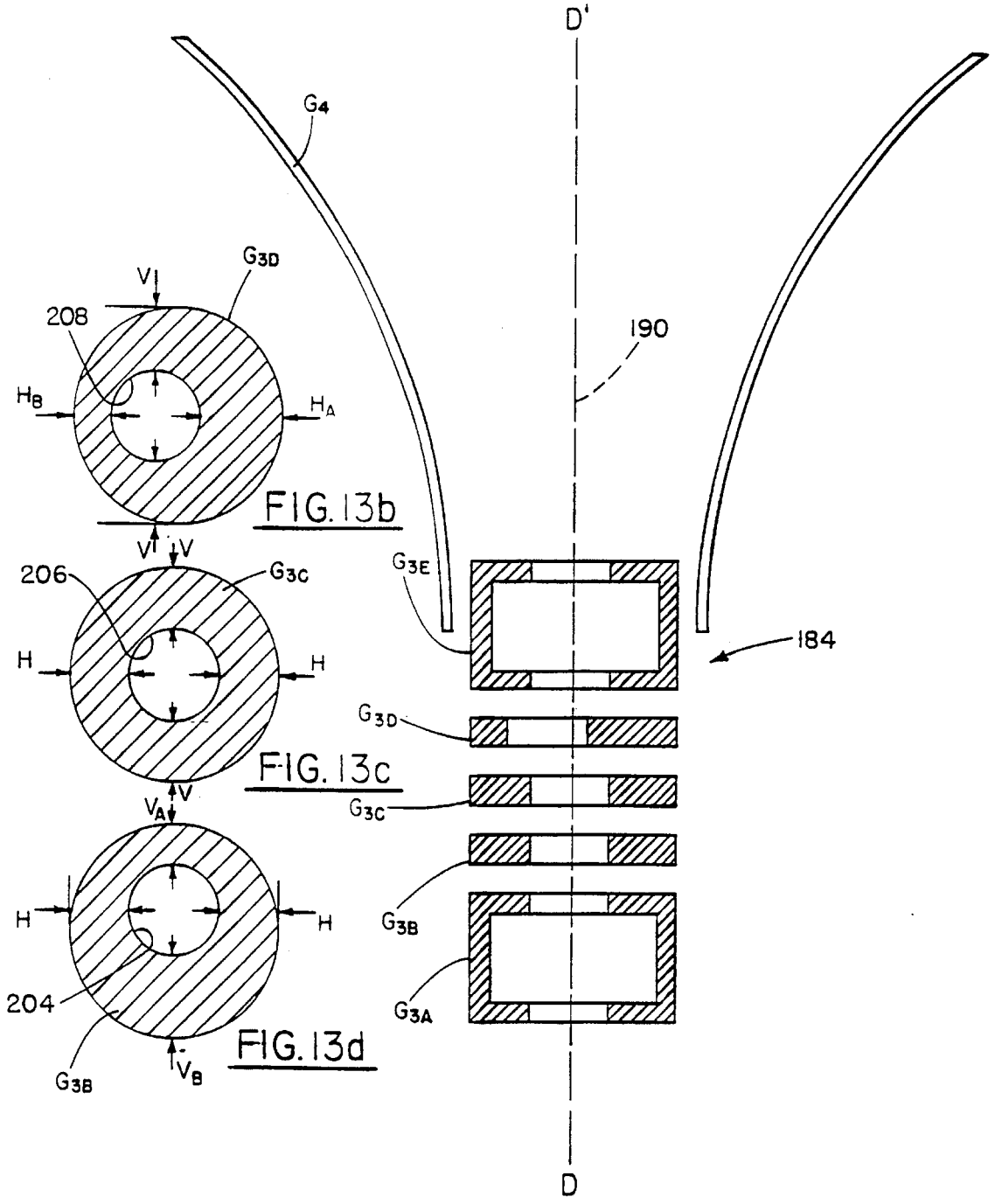
FIG. 13*a* is a simplified longitudinal sectional view of the single beam electron gun employed in the monochrome deflection lens CRT of FIG. 12 showing additional details of the electron gun.

Referring to FIG. 12, there is shown a side elevation view partially in section of a monochrome deflection lens CRT 186 having a single electron beam 190 (shown in dotted-line form) and incorporating an electron gun 184 for providing dynamic off-axis defocusing correction for the electron beam in accordance with the present invention. Details of the operation and configuration of monochrome deflection lens CRT 186 are provided in co-pending application, Ser. No. 07/874,043, referenced above. A simplified longitudinal sectional view of electron gun 184 is shown in FIG. 13. CRT 186 includes a glass envelope 188 including a neck portion 188*a*, a frusto-conical funnel portion 188*b*, and a display screen 196. Disposed on or adjacent to the inner surface of display screen 196 is a phosphor coating 198 which emits light when electron beam 190 is incident thereon. Electron beam 190 is deflected over the inner surface of display screen 196 in a raster-like manner by means of a magnetic deflection yoke 194, where the electron beam in a deflected position is shown as element 190'. Electron gun 184 includes a cathode K, and $G_1$, $G_{3A}$, $G_{3B}$, $G_{3C}$, $G_{3D}$, $G_{3E}$ and $G_4$ charged grids. The $G_4$ grid is disposed on or adjacent to the inner surface of the CRT's frusto-conical funnel portion 188*b* and is coupled to an anode button 200 extending through the CRT's glass envelope 188 for connecting the $G_4$ grid to an anode voltage ($V_A$) source (not shown). Also disposed on the inner surface of the CRT's glass envelope 188 generally where the neck and funnel portions meet is a resistive coating 202 which is disposed over a portion of the $G_4$ grid extending toward cathode K. A bulb spacer 192 is attached to the $G_{3E}$ grid and engages by means of a plurality of contact clips resistive coating 202 for providing support for and maintaining the $G_1$–$G_{3E}$ grids in position within the neck portion 188*a* of the CRT's glass envelope 188.

The $G_4$ grid in combination with a facing portion the $G_{3E}$ grid forms a deflection focus lens in the vicinity of the magnetic deflection yoke 194. The $G_1$ and $G_2$ grids each include respective circular beam-passing apertures centered on the CRT's longitudinal axis D–D'. The $G_{3A}$ and $G_{3E}$ grids similarly each include a pair of aligned circular beam-passing apertures in facing portions thereof which apertures are also centered on the CRT's longitudinal axis D–D'. The $G_{3B}$, $G_{3C}$ and $G_{3D}$ grids are in the general form of flat plates and include respective circular beam passing apertures 204, 206 and 208 as shown in the left-hand portion of FIG. 13 which shows these grids in a front elevation view. Beam passing aperture 206 is aligned with the CRT's longitudinal axis D–D' and is centered in the $G_{3C}$ grid, where portions of the $G_3$ grid above and below the aperture are given by the value V and portions of the grid to the left and right of the aperture are given by the value H. Aperture 204 in the $G_{3B}$ grid is also horizontally centered within the grid, where the dimensions of those portions to the right and left of the aperture to the lateral outer edge of the grid are given by the value H. However, aperture 204 is located in an upper portion of the $G_{3B}$ grid such that the dimension of the grid above the aperture is given by the value $V_A$, while the dimension of the grid below the aperture is given by the value $V_B$, where $V_B>V_A$. Beam passing aperture 204 is thus centered above axis D–D'. Aperture 208 is vertically centered within the $G_{3E}$ grid such that the dimensions of those portions of the grid above and below the aperture are given by the value V. However, aperture 208 is horizontally off-center within the $G_{3E}$ grid such that the dimension of the grid to the left of the aperture is given by the value $H_B$, while the dimension of the grid to the right of the aperture is given by the dimension $H_A$, where $H_A>H_B$. Beam passing aperture 208 is thus centered to the left of axis D–D'. When the $G_{38}$ and $G_{3D}$ grids are biased by a proper voltage, the off-center positioning of the beam passing apertures 204 and 208 respectively therein provide vertical and horizontal defocusing correction for electron beam 190 when deflected off-axis. By coupling the $G_{3B}$ grid to a first variable voltage source, or a $V_{DYN}$ (VERT) source (not shown), and coupling the $G_{3D}$ grid to a second variable voltage source, or $D_{DYN}$ (HOR) source (not shown), dynamic off-axis defocusing correction is provided in accordance with the present invention.

Figure 3:
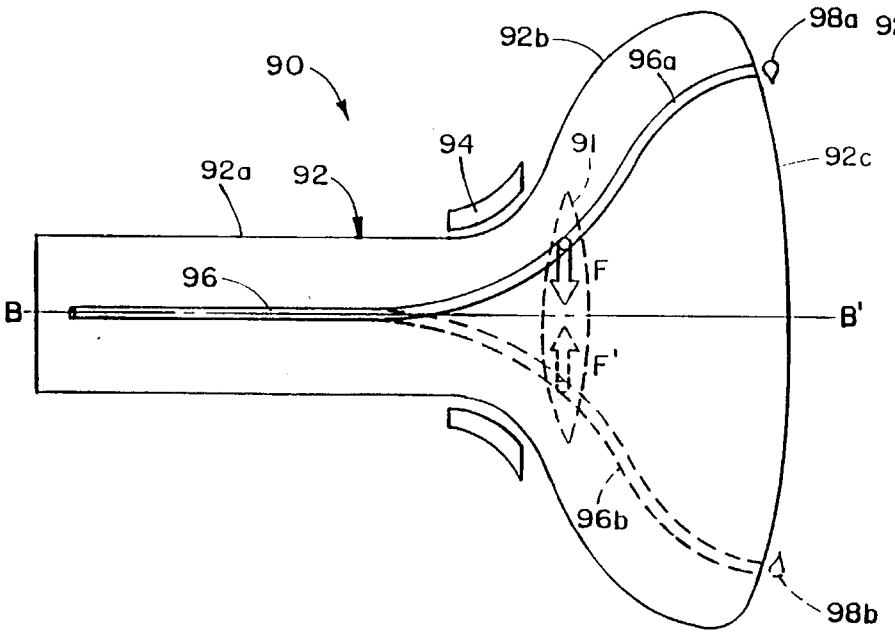
FIG. 3 (PRIOR ART)
FIG. 3 is a simplified schematic diagram of a CRT illustrating the manner in which off-axis deflection of an electron beam in the CRT gives rise to electron beam spot distortion on the CRT's display screen.
Figure 14A:
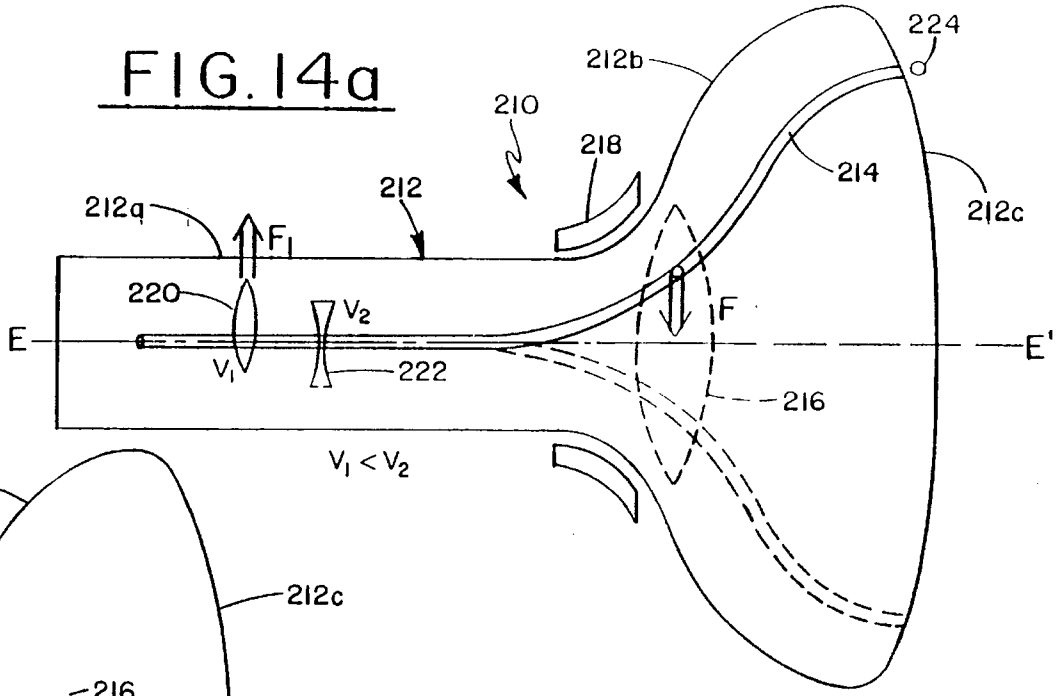
FIGS. 14*a* and 14*b* are simplified schematic diagrams of a CRT illustrating the manner in which off-axis deflection defocusing of an electron beam in the CRT is corrected by the present invention.
Figure 14B:
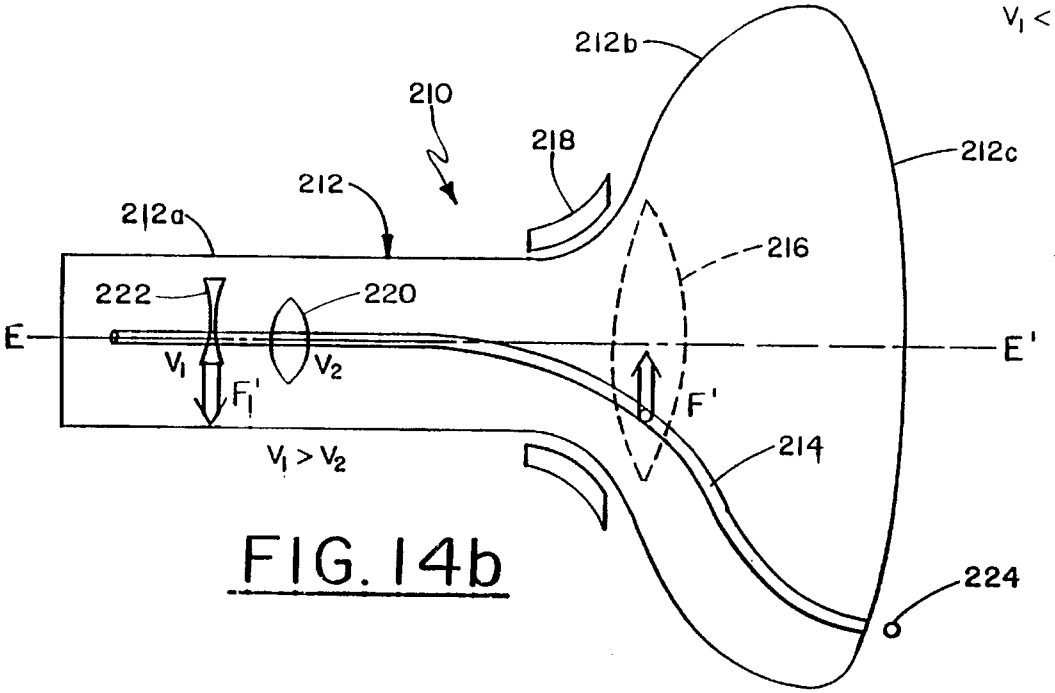

Referring to FIG. 14*a*, there is shown a simplified schematic diagram of a CRT 210 wherein deflection of an electron beam 214 from the CRT's axis E–E' gives rise to an imbalance in the symmetrical electrostatic force applied to the beam. An unsymmetrical force F is applied to electron beam 214 toward axis E–E' when the beam is deflected off-axis as previously described and illustrated in FIG. 3. CRT 210 includes a glass envelope 212 having a neck portion 212*a*, a funnel portion 212*b* and a display screen 212*c*. Electron beam 214 is generated and directed onto display screen 212*c* by an electron gun (not shown) as described above. Electron beam 214 is disposed along the CRT's longitudinal axis E–E' in the neck portion 212*a* of the CRT's glass envelope 212. As electron beam 214 is deflected across faceplate 212*c* by a magnetic deflection yoke 218, an unsymmetrical force F is applied to the electron beam in the direction of, or toward, the CRT's longitudinal axis E–E'. The unsymmetrical force exerted the electron beam 214 increases with the deflection of the beam from axis E–E' and gives rise to defocusing of the electron beam as described above. As shown in FIG. 14*a*, when electron beam 214 is deflected upward a downward force F is exerted on the beam, while an upward force F' is exerted on the beam when the beam is deflected downward as shown in FIG. 14*b*. In FIGS. 14*a* and 14*b*, the deflection lens equivalent is shown in dotted-line form as element 216.

Figure 15:
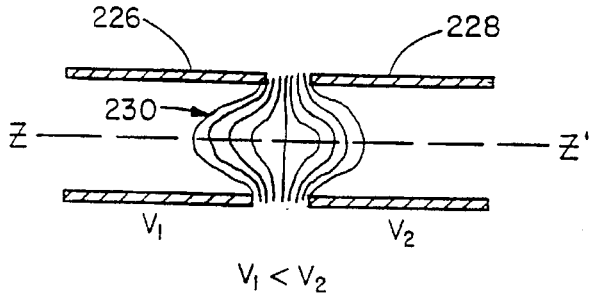
FIGS. 15–20 are simplified schematic diagrams of various cylindrical grid and equivalent lens combinations which are helpful in explaining the operation of the present invention.
Figure 16:
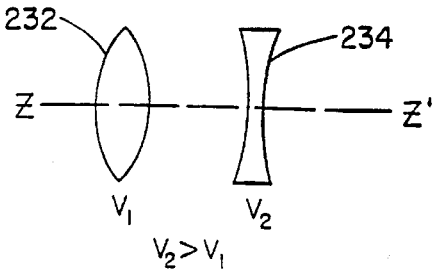

In accordance with the present invention, the dynamic off-axis defocusing correction for the deflection lens CRT exerts a correction force $F_1$ on the electron beam 214 to provide a circular electron beam spot 224 on the CRT's display screen 212*c* as described by the following. In describing the operation of the present invention reference will also be made to the simplified sectional schematic diagrams of FIGS. 15, 16, 17, 18 and 19 as well as to FIGS. 14*a* and 14*b*. A sectional view of a pair of cylindrical charged grids 226 and 228 forming a two cylindrical grid electrostatic lens design is shown in FIG. 15. With the first cylindrical grid 226 maintained at a voltage $V_1$ and the second cylindrical grid 228 maintained at a voltage $V_2$, where $V_2>V_1$, equipotential lines 230 in the electrostatic lens are as shown in the figure. Electron optically the cylindrical lens comprised of grids 226 and 228 aligned along axis Z–Z' can be represented as two individual lenses, one a converging lens 232 and the other a diverging lens 234 as shown in FIG. 16. The converging lens 232 is always on the low voltage side, while the high voltage side of the cylindrical lens combination is always a diverging lens 234. With the converging lens at a voltage $V_1$ and the diverging lens 234 at a voltage $V_2$, where $V_2>V_1$, the combination of the two lenses will have a converging effect on the electron beam.

Figure 17:
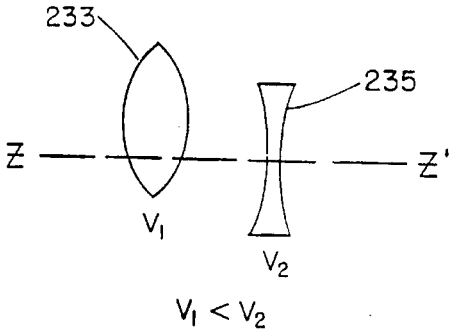
Figure 18:
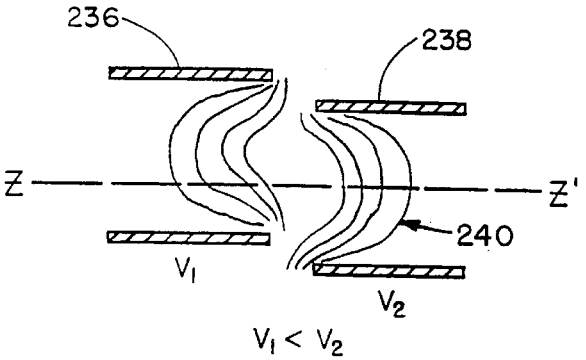

In accordance with the present invention, the first lens through which the electron beam passes (or the lens on the left in the figures) is offset from the axis Z–Z' to provide defocusing correction. Thus, as shown in FIG. 17, converging lens 233 is offset in the +Y direction from the optical axis Z–Z' of the lens and is maintained at a voltage $V_1$. The diverging lens 235 of the combination is disposed on the optical axis Z–Z' of the lens and is maintained at a voltage $V_2$. With the converging lens at a voltage $V_1$ and the diverging lens at a voltage $V_2$, $V_2>V_1$. This arrangement is shown in the sectional view of FIG. 18 which shows a first cylindrical grid 236 represented as converging lens 233 in FIG. 17 aligned above optical axis Z–Z' and a second cylindrical grid 238 represented as diverging lens 235 in FIG. 17 disposed along the optical axis Z–Z'. The equipotential lines 240 for the case where $V_2>V_1$ are shown in FIG. 18. By modulating the voltage $V_1$ on the first converging lens with deflection of the electron beam from the optical axis Z–Z', the off-axis lens arrangement shown in FIGS. 17 and 18 corrects for off-axis defocusing of the electron beam.

Figure 19:
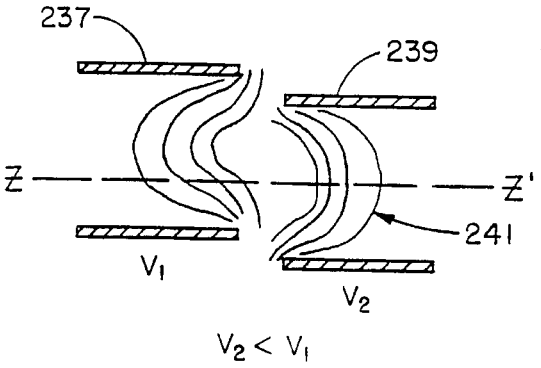
Figure 20:
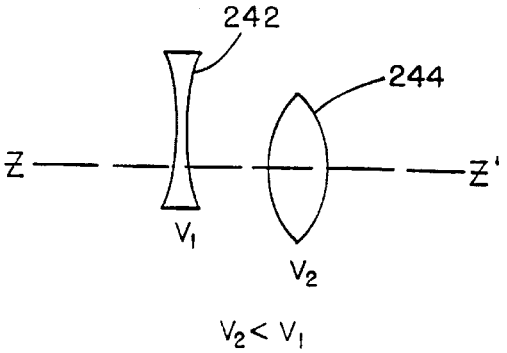

FIG. 19 is a simplified sectional view of another embodiment of the present invention including first and second cylindrical grids 237 and 239 respectively charged to voltages $V_1$ and $V_2$, where $V_2<V_1$. The first cylindrical grid 237 functions as a diverging lens and is offset in the +Y direction from the optical axis Z–Z', while the second cylindrical grid 239 is aligned with axis Z–Z' serves as a converging lens. Equipotential lines 240 formed by grids 237 and 239 are also shown in the figure. FIG. 20 shows the first grid as a diverging lens 242 and the second grid as a converging lens 244 respectively maintained at voltages $V_1$ and $V_2$, where $V_1>V_2$. By modulating the voltage applied to the first grid 237 (diverging lens) with electron beam deflection, the off-axis defocusing correction is provided by the arrangements of FIGS. 19 and 20 may be realized.

Referring back to FIGS. 14*a* and 14*b*, the operation of the present invention in terms of the off-axis converging and diverging lenses discussed above will now be described. As shown in FIG. 14*a*, when electron beam 214 is deflected by means of the magnetic deflection yoke 218 above CRT axis E–E', an unsymmetrical electrostatic force F which increases with the distance of the beam from the axis is exerted upon the beam in the direction of the axis. Similarly, as shown in FIG. 14*b* when electron beam 214 is deflected downwardly below the CRT's longitudinal axis E–E', an upwardly directed aberration force F' is exerted on the beam. This aberration force arises from the deflection lens 216 shown in dotted-line form in the figures in the vicinity of the magnetic deflection yoke 218. In order to compensate for the aberration force, an off-axis electron gun arrangement as described above is provided in the CRT's neck portion in accordance with the present invention. For example, as shown in FIG. 14*a*, an off-axis converging lens 220 may be used in combination with an on-axis diverging lens 222, where the converging and diverging lenses are respectively maintained at voltages $V_1$ and $V_2$ and where $V_1<V_2$. By modulating $V_1$ as the electron beam 214 is deflected, this combination of converging and diverging lenses within the CRT's electron gun will produce a dynamic off-axis defocusing correction force $F_1$ in an upward direction as shown in FIG. 14*a*. This is similar to the arrangement of FIGS. 17 and 18 described above. Similarly, when electron beam 214 is deflected downwardly below axis E–E' and experiences an upwardly directed aberration force F', a diverging lens 222 in combination with a converging lens 220 may be provided for in the CRT's electron gun as shown in FIG. 14*b*. In this case, the diverging lens 222 is maintained at a dynamic voltage $V_1$ and the converging lens 220 is maintained at a fixed voltage $V_2$, where $V_1>V_2$. This is similar to the arrangement of FIGS. 19 and 20 described above. By thus mechanically offsetting a horizontal and vertical grid and providing proper dynamic voltage to them, we can obtain the correction effects to the deflecting lens' off-axis deflection aberration. The applied dynamic voltages (the horizontal dynamic voltage to the horizontally offset grid and the vertical dynamic voltage to the vertically offset grid) are proportional and in sync with yoke deflection. Both the horizontal and vertical dynamic voltage can swing from a maximum to a minimum with $V_2$ as the mid-point of the swing, where $V_2$ is the fixed voltage on the adjacent grid. This means that by varying the dynamic voltage, the offset lenses can change polarity and strength in sync with the electron beam's off-axis movement in the main lens and correct the deflection defocus effects.

Figure 21:
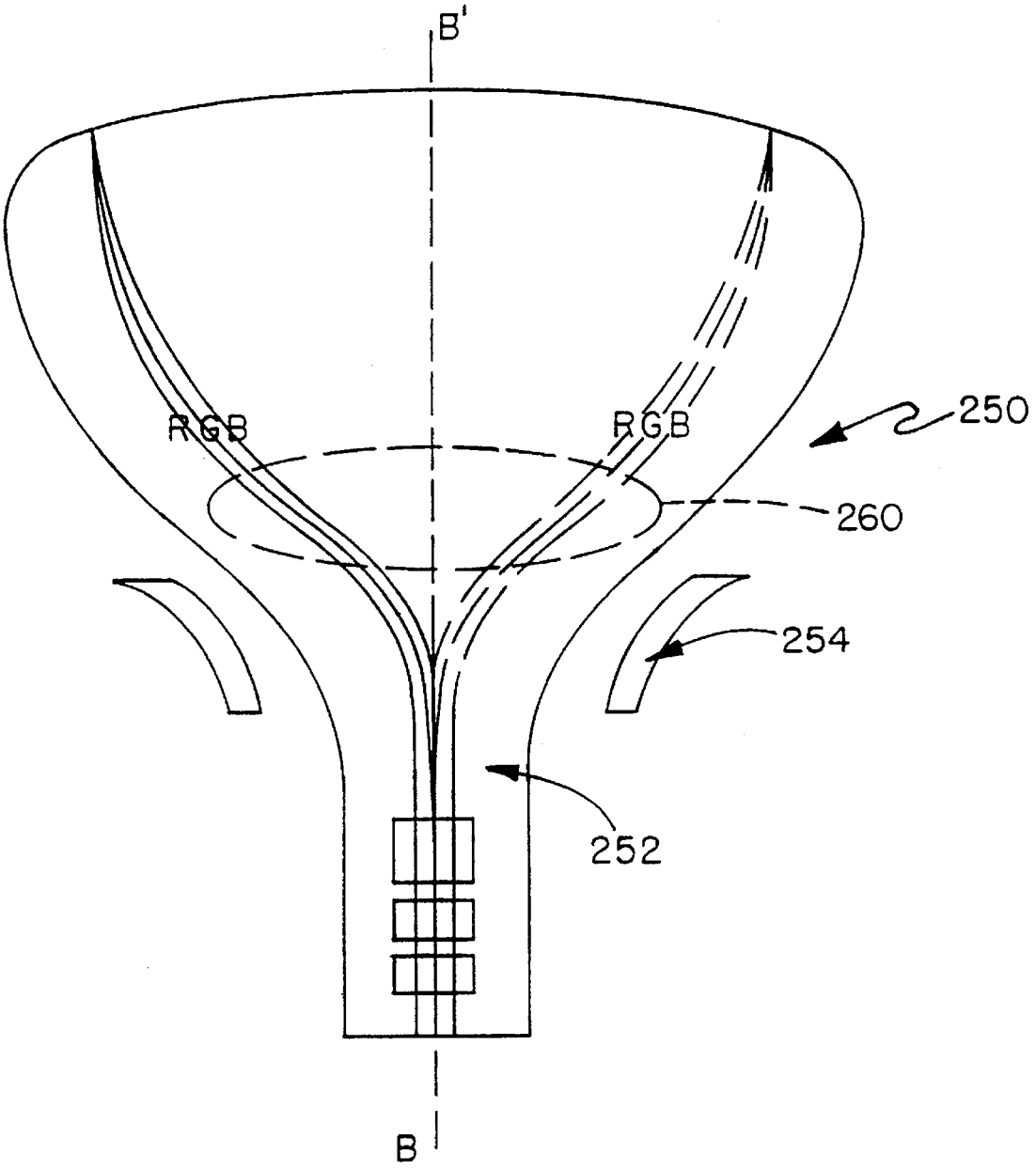
FIG. 21 is a simplified schematic diagram of a color CRT illustrating horizontal deflection of the electron beams and their relative positions as they transit the deflection lens of the present invention.

Referring to FIG. 21, there is shown a simplified longitudinal sectional view of a color CRT 250 incorporating an inline multi-beam electron gun 252 having a deflection lens 260 (shown diagrammatically in dotted line form in the shape of an oval) where the electron beams are shown deflected horizontally. The three electron beams are represented by the letters R, G and B and are shown in solid lines deflected to the left of the CRT's (and electron gun's) longitudinal axis B–B' and deflected to the right of the longitudinal axis in dotted line form. Disposed about the CRT's glass envelope is a magnetic deflection yoke 254. As shown in FIG. 21, as the three electron beams R, G and B transit the deflection lens 260 and are deflected leftward or rightward, the electron beams are horizontally displaced from one another and become defocused as they transit the deflection lens.

Figure 22:
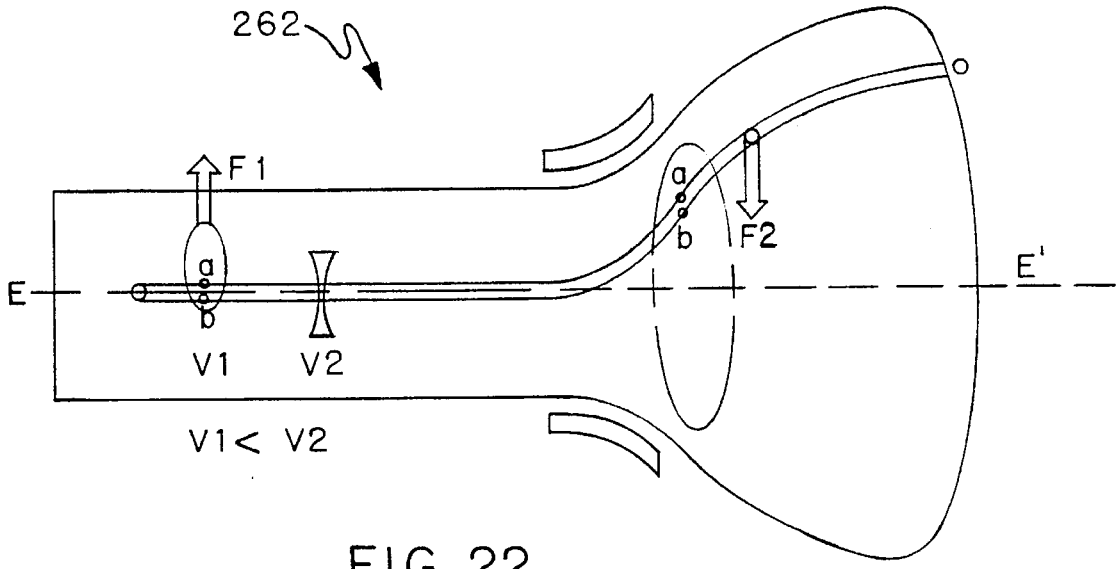
FIG. 22 is a simplified schematic diagram of a color CRT illustrating upward deflection and upward offset of the electron beams as well as the mismatch between the correction force $F_1$ and the defocusing force $F_2$ exerted on the electron beams.
Figure 23:
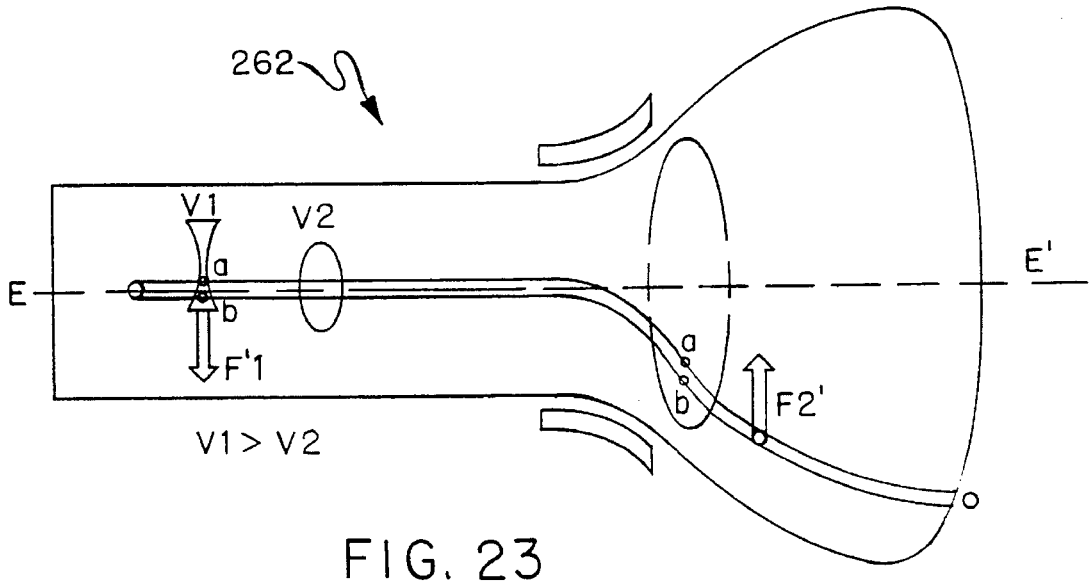
FIG. 23 is a simplified schematic diagram of a color CRT illustrating downward deflection and upward offset of the electron beams as well as the mismatch between the correction force $F_1'$ and the defocusing force $F_2'$ exerted on the electron beams.

As described above, it is possible to compensate for the off-axis defocusing effect in the deflection lens by using two offset dynamic focus correction grids, one for horizontal correction and one for vertical correction. A vertical correction arrangement employing a single vertically offset beam passing aperture is shown in the simplified schematic diagram of FIG. 22 where the electron beams are shown deflected upwardly, while the vertical correction arrangement is shown in the simplified schematic diagram of FIG. 23 for the case where the beams are deflected downwardly. As described above, in order to use only one offset apertured grid to correct for vertical deflection defocusing of the electron beam or horizontal deflection defocusing of the electron beam, the embodiment of the invention described above varies the offset grid's voltage polarity with respect to its immediately adjacent grids, as indicated in FIGS. 22 and 23. In FIG. 22, $V_1<V_2$, while in FIG. 23, $V_1>V_2$. FIG. 22 shows that when electron beam offset is in the same direction as beam deflection, i.e., the offset is above axis E–E' and the beam is also deflected above axis, the relative strengths of the correction force $F_1$ and the defocusing force $F_2$ are mismatched at points a and b in the electron gun's deflection lens. Maximum defocusing occurs at the upper portion of the electron beam (point a), while maximum correction occurs at the lower portion of the electron beam (point b). In FIG. 23, electron beam offset is above the CRT's longitudinal axis E–E' but the beam is deflected below the axis. In this case, maximum defocusing occurs at a lower portion of the electron beam (point b), while maximum correction also occurs at the lower portion of the beam (point b). Therefore, in this situation, where the beam offset is above the axis and the beam is deflected below the axis, the correction force $F_1$ and the defocusing force $F_2$ are matched at points a and b in the electron gun's deflection lens. This discussion is also applicable to the defocusing and correction mechanism of the deflection lens in the horizontal direction. When electron beam offset and deflection are on the same side of the CRT axis E–E' the correction force and defocusing force are mismatched. To address this situation, another embodiment of the deflection lens of the present invention employs four offset grids, two for horizontal correction and two for vertical correction as described below.

FIGS. 22 and 23 illustrate the situation for a single offset grid for electron beam vertical defocusing correction. In FIG. 22, $V_1<V_2$ and the offset lens is convergent. In FIG. 23, $V_1>V_2$ and the offset lens is divergent. Therefore, in the two offset plate approach described above and illustrated in FIGS. 22 and 23, the deflection lens electron gun employs one horizontally offset aperture grid and one vertically offset apertured grid. By changing the polarity of the offset apertured grids with respect to their immediately adjacent charged grids, the left/right and up/down defocusing corrections for the electron beams may be achieved.

Figure 24:
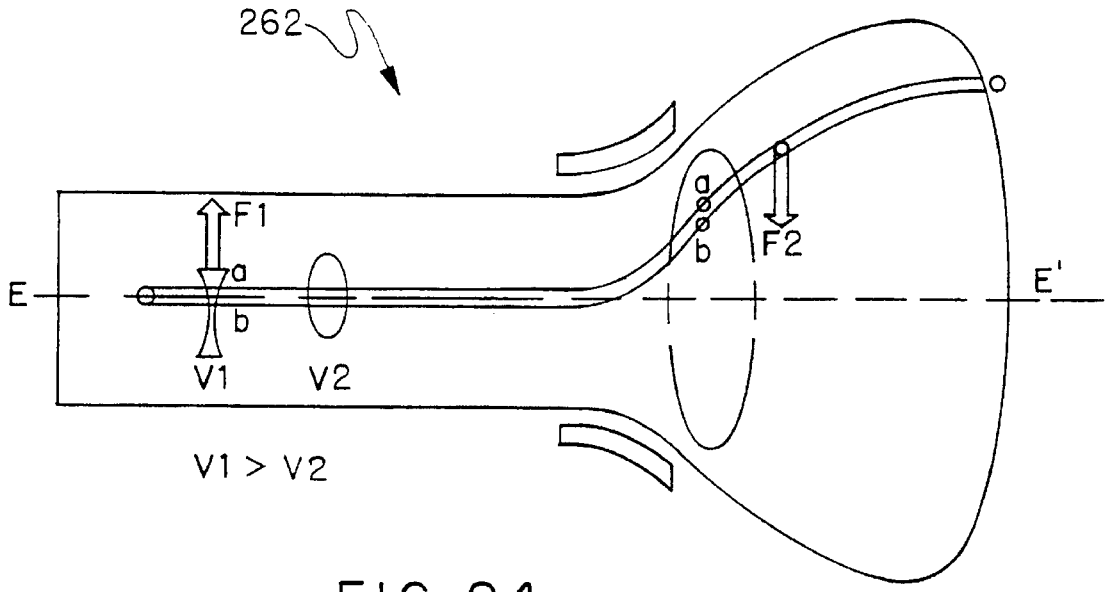
FIG. 24 is a simplified schematic diagram of a color CRT illustrating upward deflection and downward offset of the electron beams as well as matching of the correction force $F_1$ and the defocusing force $F_2$ applied to the electron beams in accordance with the present invention.
Figure 25:
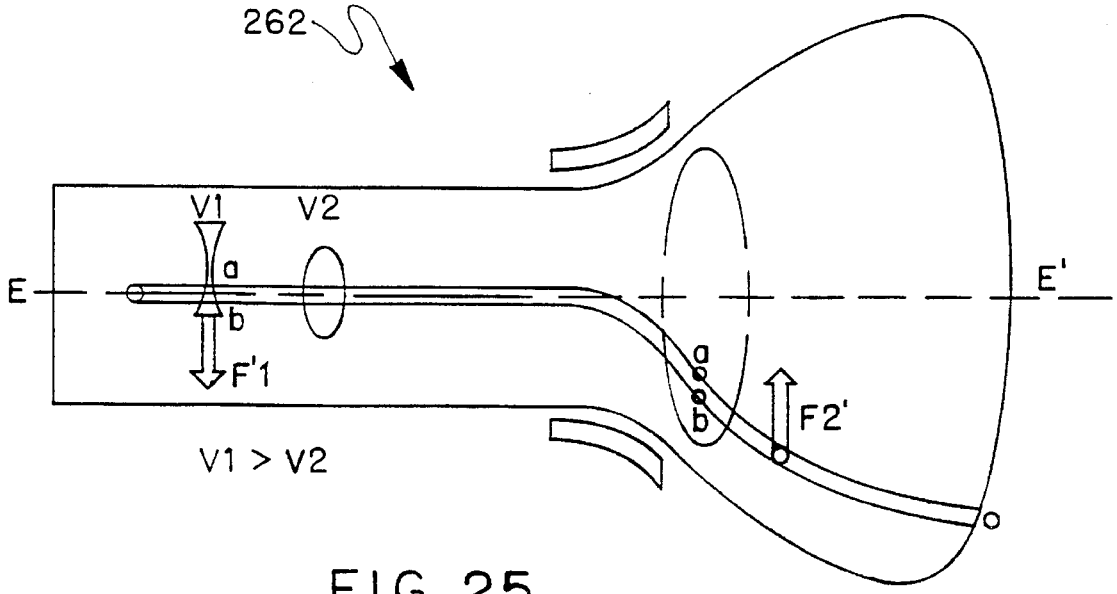
FIG. 25 is a simplified schematic diagram of a color CRT illustrating downward electron beam deflection and upward electron beam offset as well as matching of the correction force $F_1'$ and defocusing force $F_2'$ applied to the electron beams in accordance with the present invention.

In order to correct for the mismatch between the correction force $F_1$ and the defocusing force $F_2$ described above, another embodiment of the deflection lens of the present invention employs two additional charged grids to the embodiment described above, each having one (in a monochrome CRT) or a plurality (in a color CRT) of vertically or horizontally offset beam passing apertures as described below. Referring to FIGS. 24 and 25, there is shown the matching of the correction force $F_1$ and defocusing force $F_2$ for upwardly and downwardly deflected electron beams, respectively, provided in a deflection lens electron gun employing two charged grids, one having an upwardly offset beam passing aperture (or apertures) and the other having a downwardly offset beam passing aperture (or apertures) in accordance with another embodiment of the deflection lens electron gun of the present invention. In the embodiment shown in FIGS. 24 and 25, the correction force $F_1$ is opposite to and matches the main lens defocusing force $F_2$. In addition, the amplitude and timing of the correction force, i.e., the force exerted on the electron beams by the grids having vertically offset apertures, is synchronized with electron beam deflection by varying the dynamic correction voltage waveform timing and amplitude to match the beam's deflection timing and degree of defocusing. A corresponding pair of apertures having left and right horizontally offset beam passing apertures in another pair of charged grids may be employed to correct for horizontal defocusing of the electron beams with electron beam horizontal deflection. At any instant, only one horizontally offset grid and one vertically offset grid are activated, the other two offset grids, one horizontal and one vertical, are biased to have the same voltage as their neighboring grids and become inactive.

Figure 26:
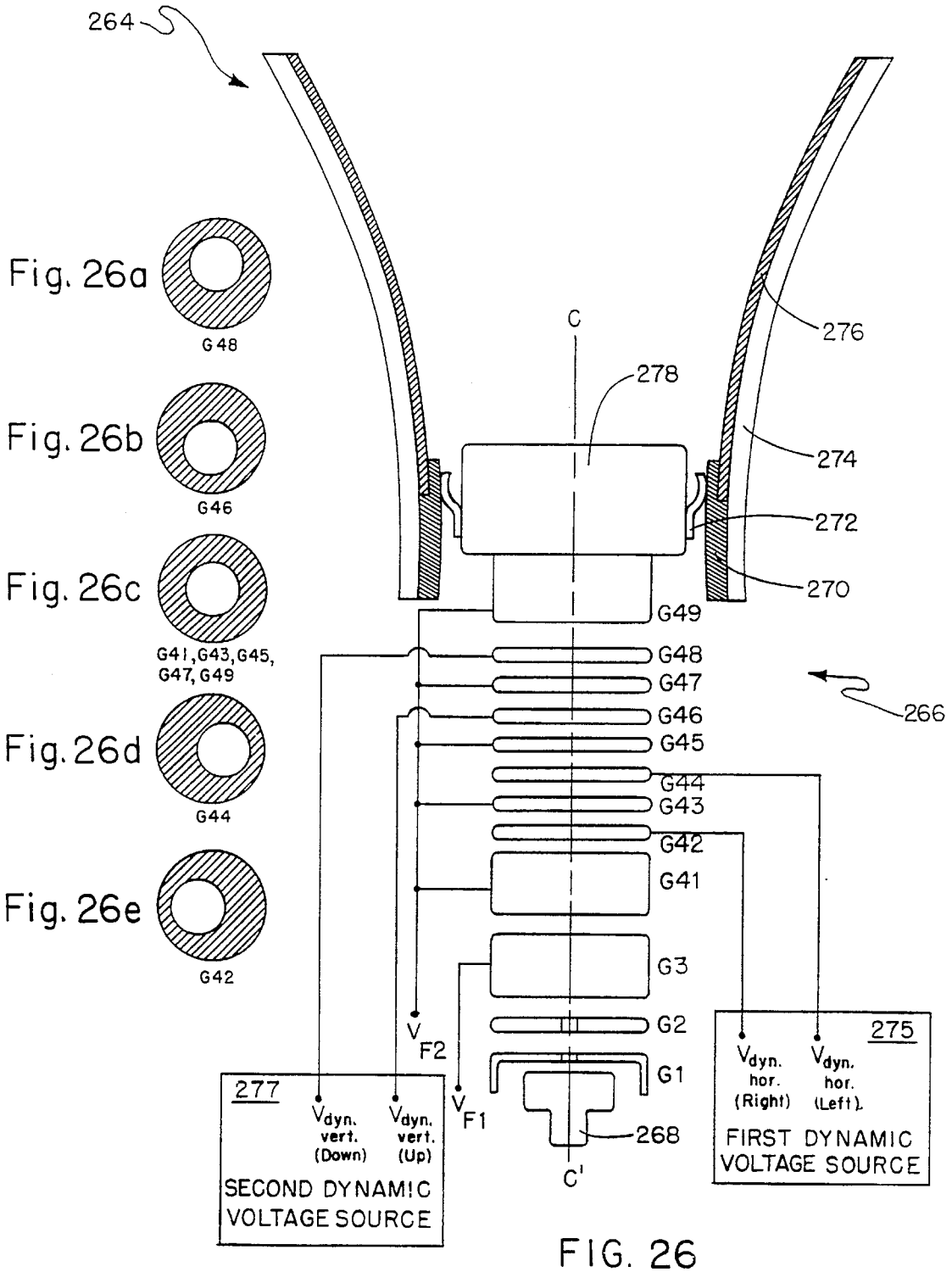
FIG. 26 is a simplified longitudinal sectional view of a deflection lens electron gun in a monochrome CRT in accordance with another embodiment of the present invention.

Referring to FIG. 26, there is shown a simplified longitudinal sectional view of a single beam electron gun 266 employing a dynamic off-axis defocusing correction arrangement for a deflection lens CRT in accordance with another embodiment of the present invention for use in a monochrome CRT 264. The monochrome CRT 264 is also shown in simplified schematic diagram form as including a funnel glass portion 274 having a conductive coating 276 disposed on the inner surface thereof in forming a portion of electron gun 266. Also disposed on the inner surface of the funnel glass 274 is a resistive coating 270 which is engaged by and contacts a plurality of bulb spacers 272 attached to a cup shaped metal electrode 278. Electron gun 266 is shown having a longitudinal axis C–C' and as including a cathode 268. Electron gun 266 includes a $G_4$ grid divided into nine separate grids G41 through G49. Four of these grids have beam passing apertures offset from the electron gun's axis C–C' while five of these grids have beam passing apertures which are centered on axis C–C'. Elevation views of grids G41–G49 are shown in FIGS. 26*a*–26*e*. As shown in these figures, the G42 and G44 grids have beam passing apertures which are horizontally offset in opposite directions from the electron gun's axis C–C'. Similarly, grids G46 and G48 have beam passing apertures which are vertically offset in opposite directions from the electron gun's axis C–C'. Grids G41, G43, G45, G47 and G49 all have beam passing apertures which are centered on the electron gun's axis C–C' as shown in FIG. 26*c*. As shown in FIG. 26, grids G41 and G49 are cup-shaped, while grids G42–G48 are in the form of flat plates. Grids G42 and G44 having horizontally offset beam passing apertures are respectively coupled to right and left horizontal dynamic voltage sources in a first dynamic voltage source 275 for correcting for horizontal defocusing of the electron beam. Similarly, grids G46 and G48 having vertically offset beam passing apertures are respectively coupled to up and down vertical dynamic correction voltage sources in a second dynamic voltage source 277. Grids G41, G43, G45, G47 and G49 are coupled to and charged by a fixed, adjustable focusing voltage VF2. Each of the grids to which either a horizontal or vertical dynamic correction voltage is applied is disposed between two grids to which the focus voltage VF2 is applied, where the fixed voltage grids all have their respective beam passing apertures aligned with and centered on the electron gun's axis C–C'.

Figure 27:
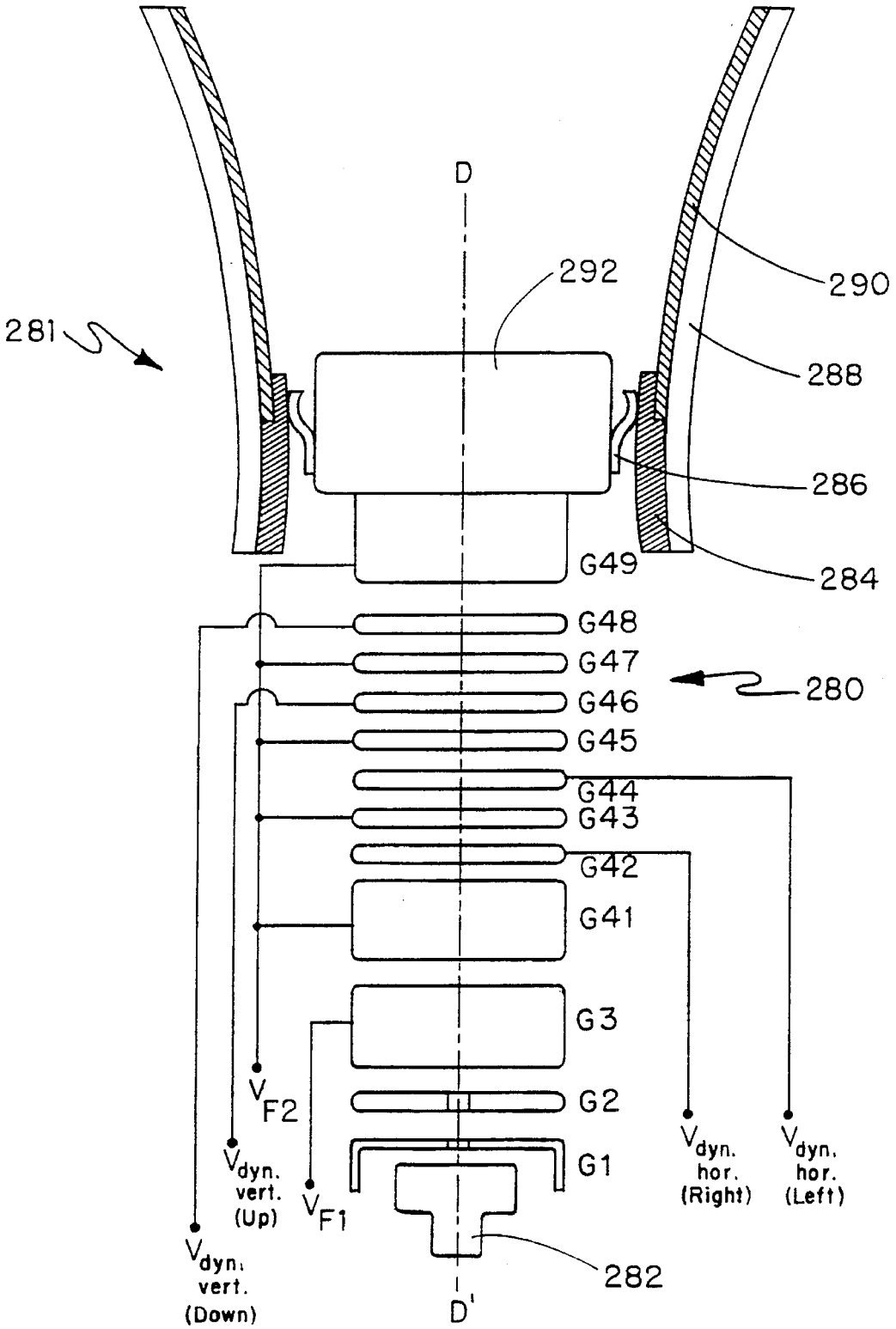
FIGS. 27 is a longitudinal sectional view of another embodiment of a multi-beam deflection lens electron gun for use in a color CRT in accordance with yet another embodiment of the present invention.

Referring to FIG. 27, there is shown an inline color deflection lens electron gun 280 for use in a multi-beam color CRT 281 in accordance with another embodiment of the present invention. The color CRT 281 includes a funnel glass portion 288 having a conductive coating 290 disposed on its inner surface and forming the deflection lens portion of the electron gun. Also disposed on the inner surface of the CRT's funnel glass 288 is a resistive coating 284 which is engaged by and in contact with a plurality of bulb spacers 286 which maintain the electron gun's metal support or convergence cup 292 in position within the CRT and aligned with the CRT's longitudinal axis D–D'.

Figure 27A:
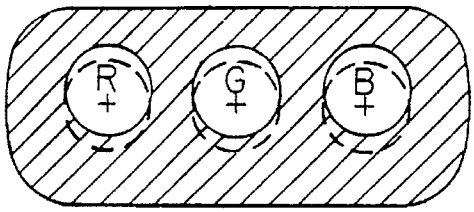
FIGS. 27*a*–27*e* are elevation views of various charged grids in the multi-beam deflection lens electron gun of FIG. 27.
Figure 27B:
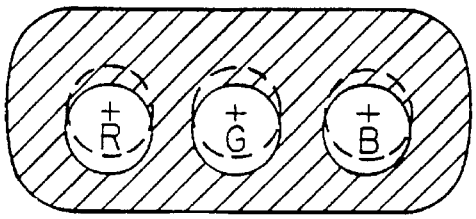
Figure 27C:
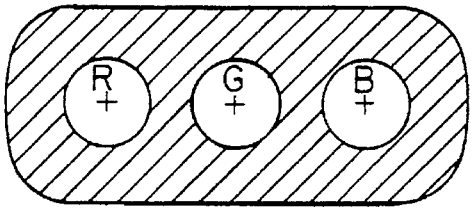
Figure 27D:
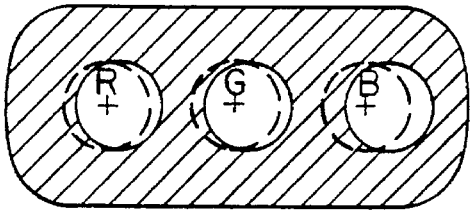
Figure 27E:
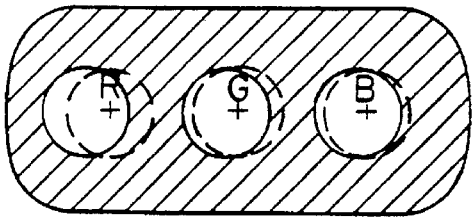

As in the monochrome embodiment of the present invention described above, the G4 electrode in the multi-beam electron gun 280 shown in FIG. 27 is divided into nine separate grids. Elevation view of each of these grids G41–G49 are shown in FIGS. 27*a*–27*e*. In FIGS. 27*a*–27*e*, the three axes of the electron gun associated with each of the three electron beams of red, green and blue are shown in dotted line form. As shown in FIG. 27*c*, grids G41, G43, G45, G47 and G49 have each of their three beam passing apertures aligned concentrically with a respective red, green or blue electron beam Z-axis. As shown in FIG. 27*e*, each of the three beam passing apertures of the G42 grid are horizontally offset to the left from the three electron beam axes. However, the three apertures in the G42 grid are offset from each of the respective electron beam axes to a different degree, or distance, because the three inline electron beams have different degrees of horizontal defocusing, as shown in FIG. 21. Viewing the CRT's display screen from in front of the CRT, with a conventional inline electron gun the arrangement of the color sequence from left to right is blue, green and red. When the three electron beams are deflected to the right, the red electron beam (on the right side) experiences the largest horizontal defocusing, the green (middle) electron beam experiences an intermediate degree of defocusing, while the blue electron beam (on the left) experiences the least amount of defocusing. In order to compensate for the differential degree of defocusing when the electron beams are deflected to the right, each individual beam passing aperture associated with one of the electron beams must be provided with a different degree of offset from the respective electron beam axis toward the left as shown in FIG. 27*e*. Thus, because the red electron beam experiences the largest horizontal defocusing when deflected to the right, the red aperture is provided with the largest offset toward the left from the red electron beam axis. The blue beam passing aperture is provided with the least horizontal offset, while the center green beam passing aperture is provided with a horizontal offset intermediate that of the red and blue beam passing apertures also as shown in FIG. 27*e*.

When the three inline electron beams are deflected toward the left lateral edge of the CRT's display screen, the blue electron beam experiences the largest defocusing, the green electron beam experiences an intermediate degree of defocusing, while the red electron beam experiences the least amount of defocusing. In order to compensate for this differential defocusing effect on the three electron beams, the blue beam passing aperture in the G44 grid is provided with the largest horizontal offset toward the right from the blue electron beam axis as shown in FIG. 27*d*. Similarly, the red beam passing aperture is provided with the least horizontal offset from the red electron beam axis, while the green beam passing aperture is provided with a horizontal offset intermediate that of the red and blue beam passing apertures also as shown in FIG. 27*d*.

In the vertical direction, i.e., up and down deflection defocusing, all three electron beams experience approximately the same degree of defocusing. Therefore, the three upwardly offset beam passing apertures in the G48 grid are provided with the same amount of vertical offset, although in the opposite direction, as the three electron beam passing apertures in the G46 grid as shown in FIGS. 27*a* and 27*b*. As shown in FIG. 27*c*, the G41, G43, G45, G47 and G49 grids are all provided with three electron beam passing apertures each of which is coincident with the axis of either a red, green or blue electron beam.

Figure 28:
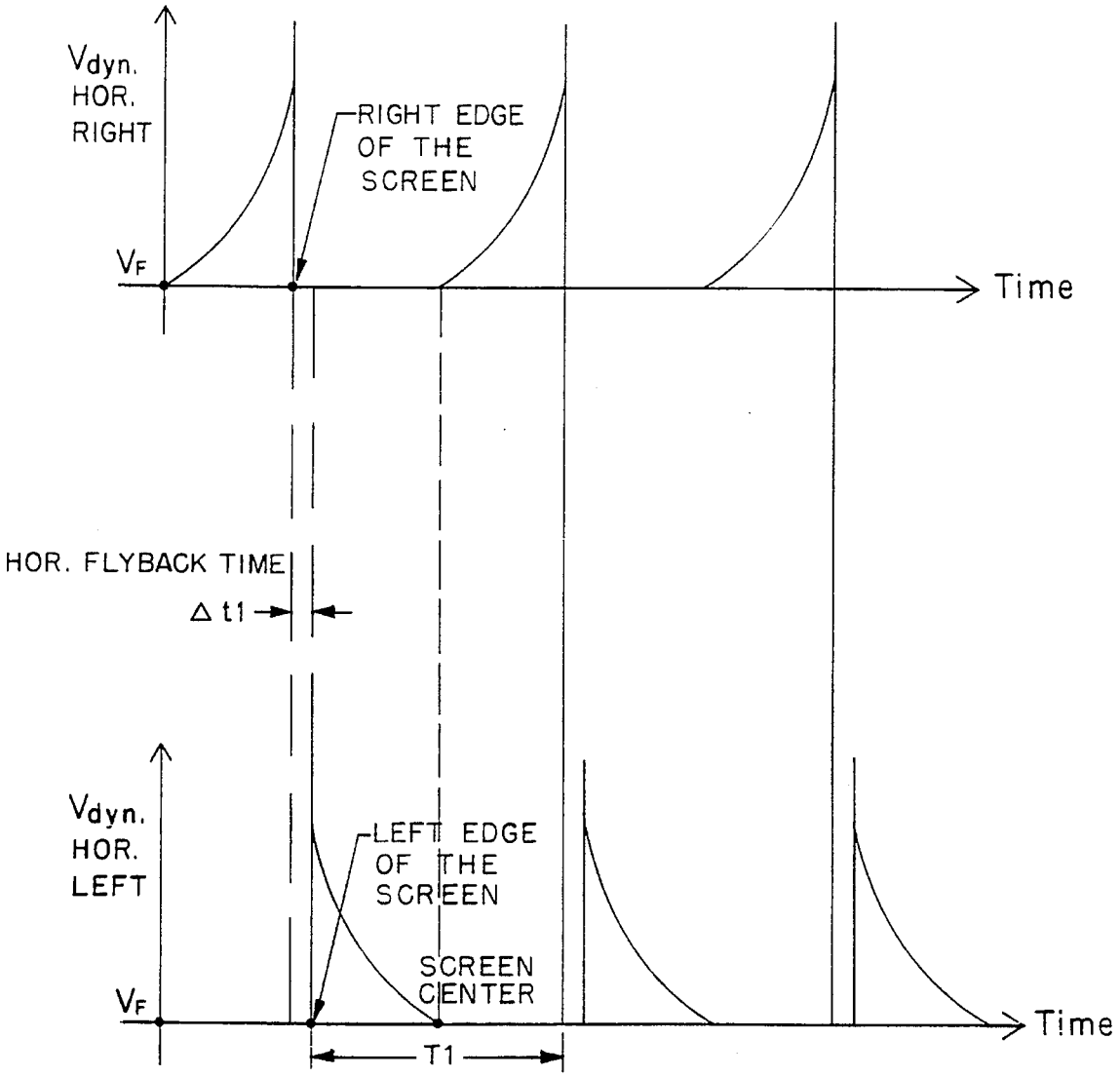
FIG. 28 is a graphic illustration of the variation of correction voltage with time applied to a focusing grid having a horizontally off-axis beam passing aperture in an electron gun such as shown in FIG. 26.
Figure 29:
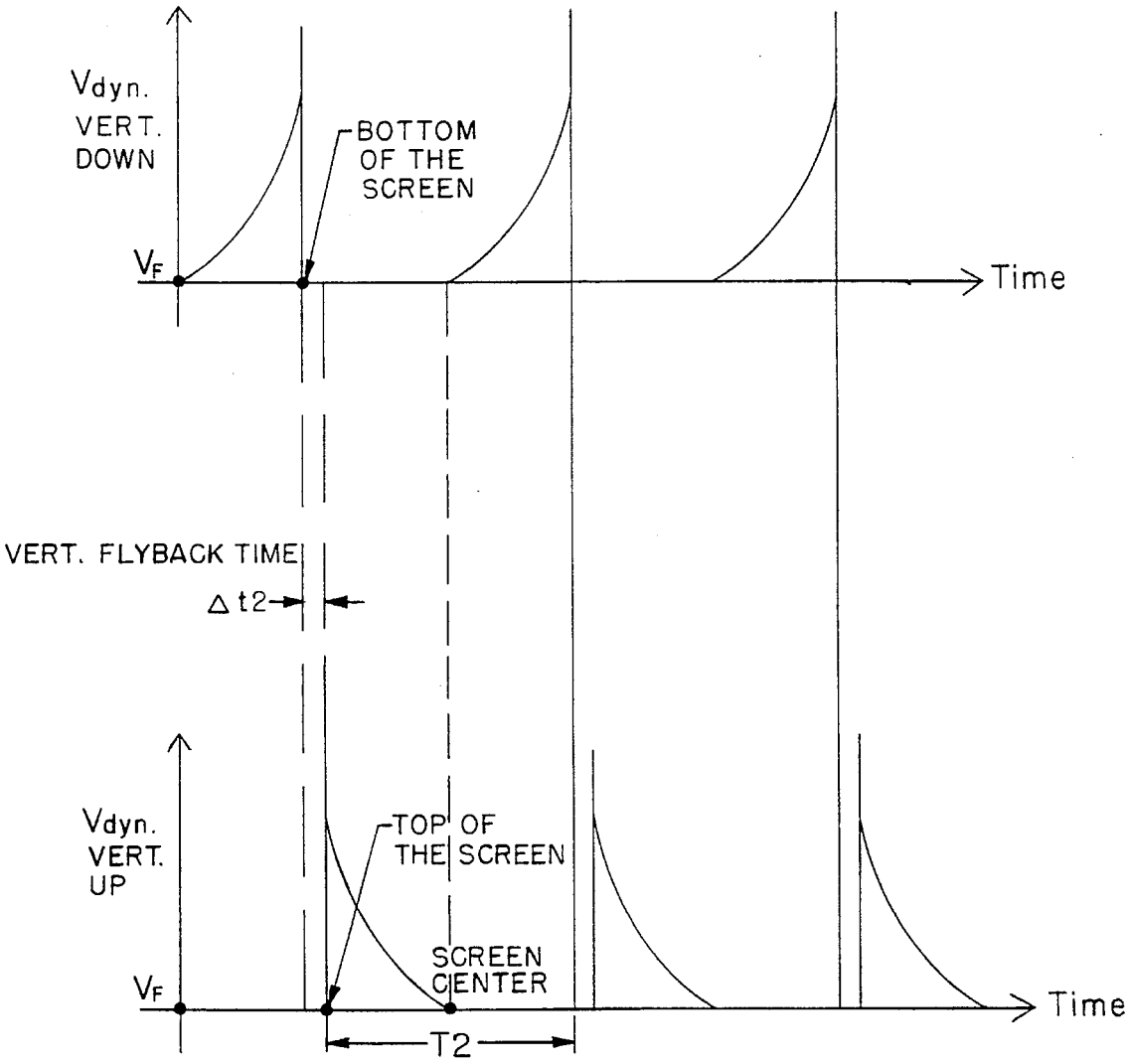
FIG. 29 is a graphic illustration of the variation of correction voltage with time applied to a focusing grid having a vertically off-axis beam passing aperture in an electron gun such as shown in FIG. 26.

Referring to FIGS. 28 and 29, there are respectively shown the variation with time of the horizontal and vertical dynamic correction voltages applied to those grids having the horizontally offset and vertically offset electron beam passing apertures described above. In this embodiment of the inventive deflection lens where dynamic voltages are applied to four grids, the dynamic correction voltages are always equal to or greater than the fixed focus voltage VF2 applied to adjacent grids having beam passing apertures concentrically aligned with the three electron beam axises. Because each defocusing correction plate having a either vertically or horizontally off-center beam passing apertures functions only during one-half of an electron beam scan duty cycle, during the inactive half cycle the voltage applied to the defocusing correction grid is equal to the fixed focus voltage VF2 applied to adjacent grids having their beam passing apertures each aligned with a respective electron beam axis. To achieve a proper correction effect, the dynamic voltages applied to the horizontal and vertical correction grids are applied synchronously with the deflection yoke's magnetic fields and are thus synchronized with electron beam sweep.

There has thus been shown a dynamic off-axis defocusing correction arrangement for use in either a monochrome or a color CRT with a deflection lens for correcting beam defocusing when deflected off-axis. Employing a dynamically charged grid having an off-axis aperture in the focusing region of the electron gun, a horizontal or vertical focus correction may be applied to the beam to focus it to a small circular spot on the CRT's display screen. Two pair's of such grids having respective horizontal and vertical offset beam passing apertures, where the grids are maintained at a dynamic voltage which varies with beam deflection from the CRT's centerline, provide a small circular beam spot at all locations on the CRT's display screen.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A cathode ray tube (CRT) comprising:

a display screen responsive to a beam of electrons incident thereon for providing an image;

a source of energetic electrons;

a low voltage beam forming means disposed intermediate said display screen and said source of energetic electrons and adjacent said source of energetic electrons for forming said energetic electrons into a beam and directing said beam along an axis of the CRT toward said display screen;

high voltage focus lens means disposed intermediate said beam forming means and said display screen on said axis for forming a beam electrostatic focus region in the CRT for focusing the electron beam to a spot on said display screen;

magnetic deflection means disposed about said focus lens means for forming a beam magnetic deflection region for deflecting the electron beam from said axis and over said display screen such that the electron beam spot is displaced across the display screen in a raster-like manner, and wherein said beam electrostatic focus region and said beam magnetic deflection region overlap and are coincident; and dynamic focus correction means in said high voltage focus lens means for applying a non-symmetric electrostatic force field to said beam, wherein said electrostatic field increases in strength with deflection of the beam from the axis of the CRT to correct for off-axis defocusing of the beam, and wherein said dynamic focus correction means includes a first plurality of charged grids disposed in a spaced manner along said axis, and wherein each grid includes a respective beam passing aperture with a first pair of grids having respective beam passing apertures disposed horizontally off-center in opposed directions relative to said axis and a second pair of grids having respective beam passing apertures disposed vertically off-center in opposed directions relative to said axis.

2. The CRT of claim 1 wherein said focus correction means further includes a second plurality of charged grids each having a respective beam passing aperture substantially centered on said axis, and wherein a first grid of said second plurality of charged grids is disposed intermediate each of said first pair of grids and a second grid of said second plurality of grids is disposed intermediate each of said second pair of grids, and wherein a third grid of said second plurality of charged grids is disposed intermediate said first and second pairs of grids.

3. The CRT of claim 2 wherein said second plurality of grids includes five charged grids each disposed intermediate or adjacent said first pair of charged grids or said second pair of charged grids, or intermediate said first and second pairs of charged grids.

4. The CRT of claim 3 wherein said first pair of charged grids include a G42 and a G44 grid, said second pair of charged grids include a G46 and a G48 grid, and said second plurality of grids include G41, G43, G45, G47 and G49 grids.

5. The CRT of claim 4 further comprising a fixed focus voltage source coupled to each of said second plurality of grids, and first and second dynamic voltage sources respectively coupled to said first pair of charged grids and to said second pair of charged grids.

6. The CRT of claim 4 wherein each of said first and second pairs of grids is generally planar and wherein upper and lower end grids of said second plurality of grids are generally cup-shaped.

7. The CRT of claim 3 wherein said CRT is a color CRT having three inline electron beams and wherein each of said charged grids includes three inline beam passing apertures, with each electron beam providing one of the primary colors of red, green or blue, and wherein the three beam passing apertures in each grid of said first pair of charged grids are horizontally off-center in opposed directions relative to an electron beam axis and the three beam passing apertures in each grid of said second pair of charged grids are vertically off-center in opposed directions relative to an electrons beam axis.

8. The CRT of claim 7 wherein said second plurality of charged grids each have three inline beam passing apertures substantially centered on a respective electron beam axis, and wherein each of said second plurality of charged grids is disposed intermediate or adjacent to a respective one of said first or second pairs of grids.

9. The CRT of claim 8 wherein said second plurality of grids includes five charged grids each disposed intermediate or adjacent said first pair of charged grids or said second pair of charged grids, or intermediate said first and second pairs of charged grids.

10. The CRT of claim 9 wherein said first pair of charged grids include a G42 and a G44 grid, said second pair of charged grids include a G46 and a G48 grid, and said second plurality of grids include G41, G43, G45, G47 and G49 grids.

11. The CRT of claim 10 further comprising a fixed focus voltage source coupled to each of said second plurality of grids, and first and second dynamic voltage sources respectively coupled to said first pair of charged grids and to said second pair of charged grids.

12. The CRT of claim 11 wherein each of said first and second pairs of grids is generally planar and wherein upper and lower end grids of said second plurality of grids are generally cup-shaped.

13. The CRT of claim 7 wherein the three beam passing apertures in each of said first pair of charged grids have a different horizontal off-center distance from an associated electron beam axis to correct for differential horizontal deflection defocusing of the three electron beams.

14. For use in a cathode ray tube (CRT) for directing a focused electron beam onto a display screen of said CRT, wherein said CRT includes a glass envelope and a magnetic deflection yoke disposed about said glass envelope and forming a beam deflection region for displacing said electron beam across said display screen in a raster-like manner, an electron gun comprising:

a source of energetic electrons;

a first plurality of co-axially aligned, metallic grids maintained at a relatively low voltage and disposed adjacent said source of energetic electrons for forming said energetic electrons into a beam and directing said beam along an axis of the CRT toward the display screen;

a second plurality of grids disposed on said axis intermediate said first plurality of metallic grids and the display screen and adjacent the magnetic deflection yoke, wherein said second plurality of grids are maintained at a relatively high voltage and form a main focus lens with a beam focus region for focusing the electron beam on the display screen, wherein said beam deflection and beam focus regions are coincident and the electron beam is simultaneously magnetically deflected and electrostatically focused, and wherein at least one of said second plurality of grids is disposed on or in close proximity to an inner surface of the CRT's glass envelope; and a third plurality of grids disposed on said axis adjacent said second plurality of grids for applying a dynamic non-symmetric electrostatic field to the electron beam, wherein said electrostatic field increases in strength with increasing deflection of the electron beam from said axis for correcting for off-axis defocusing of the electron beam, and wherein each of said third plurality of grids includes a respective beam passing aperture with a first pair of grids having respective beam passing apertures disposed horizontally off-center in opposed directions relative to said axis and a second pair of grids having respective beam passing apertures disposed vertically off-center in opposed directions relative to said axis.

15. The electron gun of claim 14 further including a fourth plurality of charged grids each having a respective beam passing aperture substantially centered on said axis, and wherein a first and a second grid of said fourth plurality of charged grids are respectively disposed intermediate each of said first pair of grids and each of said second pair of grids, and wherein a third grid of said fourth plurality of charged grids is disposed intermediate said first and second pairs of grids.

16. The electron gun of claim 15 wherein said fourth plurality of grids includes five charged grids each disposed intermediate or adjacent said first pair of charged grids or said second pair of charged grids, or intermediate said first and second pairs of charged grids.

17. The electron gun of claim 16 wherein said first pair of charged grids include a G42 and a G44 grid, said second pair of charged grids include a G46 and a G48 grid, and said third plurality of grids include G41, G43, G45, G47 and G49 grids.

18. The electron gun of claim 16 further comprising a fixed focus voltage source coupled to each of said fourth plurality of grids, and first and second dynamic voltage sources respectively coupled to said first pair of charged grids and to said second pair of charged grids.

19. The electron gun of claim 16 wherein each of said first and second pairs of grids is generally planar and wherein upper and lower end grids of said fourth plurality of grids are generally cup-shaped.

20. The electron gun of claim 16 wherein said CRT is a color CRT having three inline electron beams and wherein each of said charged grids includes three inline beam passing apertures, with each electron beam providing one of the primary colors of red, green or blue, and wherein the three beam passing apertures of each of said first pair of charged grids are horizontally off-center in opposed directions relative to an electron beam axis and the three beam passing apertures of each of said second pair of said charged grids are vertically off-center in opposed directions relative to an electron beam axis.

21. The electron gun of claim 20 wherein each of said fourth plurality of charged grids includes three inline beam passing apertures substantially centered on a respective electron beam axis, and wherein each of said fourth plurality of charged grids is disposed intermediate or adjacent to a respective one of said first or second pairs of grids.

22. The electron gun of claim 21 wherein said fourth plurality of grids includes five charged grids each disposed intermediate or adjacent said first pair of charged grids or said second pair of charged grids, or intermediate said first and second pairs of charged grids.

23. The electron gun of claim 22 wherein said first pair of charged grids include a G42 and a G44 grid, said second pair of charged grids include a G46 and a G48 grid, and said third plurality of grids include G41, G43, G45, G47 and G49 grids.

24. The electron gun of claim 23 further comprising a fixed focus voltage source coupled to each of said fourth plurality of grids, and first and second dynamic voltage sources respectively coupled to said first pair of charged grids and to said second pair of charged grids.

25. The electron gun of claim 24 wherein each of said first and second pairs of grids is generally planar and wherein upper and lower end grids of said fourth plurality of grids are generally cup-shaped.

26. The electron gun of claim 20 wherein the three beam passing apertures in each of said first pair of charged grids have a different horizontal off-center distance from an associated electron beam axis to correct for differential horizontal deflection defocusing of the three electron beams.

* * * * *

UNITED STATES PATENT AND TRADEMARK OFFICE

CERTIFICATE OF CORRECTION

PATENT NO. : 5,610,475

DATED : 3/11/97

INVENTOR(S) : Hsing-Yao Chen

It is certified that error appears in the above-indentified patent and that said Letters Patent is hereby corrected as shown below:

| COLUMN | LINE | |
|---|---|---|
| 9 | 42 | "$G_{5E}$" should be -- $G_{5B}$ --. |
| 9 | 46 | " " " " |
| 12 | 28 | "$G_{5E}$" should be -- $G_{5B}$ --. |
| 13 | 55 | "$G_{38}$" should be -- $G_{3B}$--. |
| 13 | 62 | "$D_{DYN}$" should be -- $V_{DYN}$ --. |

Signed and Sealed this

Fourteenth Day of October, 1997

*Attest:*

Bruce Lehman

BRUCE LEHMAN

*Attesting Officer*

*Commissioner of Patents and Trademarks*